US005728511A

United States Patent [19]

Hirosawa et al.

[11] Patent Number: 5,728,511

[45] Date of Patent: Mar. 17, 1998

[54] SILVER HALIDE PHOTOGRAPHIC MATERIAL AND IMAGE-FORMING PROCESS

[75] Inventors: Toshio Hirosawa; Kouji Katsube; Junichi Komiyama; Yoshiro Hayafuchi; Toshiko Nakamura, all of Kanagawa, Japan

[73] Assignee: Oriental Photo Industrial Co., Ltd., Tokyo, Japan

[21] Appl. No.: 811,923

[22] Filed: Mar. 5, 1997

[30] Foreign Application Priority Data

| | | | |
|---|---|---|---|
| Jun. 19, 1996 | [JP] | Japan | 8-178444 |
| Jun. 26, 1996 | [JP] | Japan | 8-185603 |
| Jun. 28, 1996 | [JP] | Japan | 8-188535 |
| Jul. 3, 1996 | [JP] | Japan | 8-192965 |

[51] Int. Cl.[6] ..... G03C 7/20; G03C 7/32; G03C 7/30

[52] U.S. Cl. ..... 430/356; 430/364; 430/365; 430/390; 430/402; 430/549; 430/574; 430/583; 430/584; 430/565

[58] Field of Search ..... 430/583, 584, 430/505, 574, 585, 356, 364, 365, 390.8, 402, 549, 565

[56] References Cited

U.S. PATENT DOCUMENTS

| | | | |
|---|---|---|---|
| 4,863,846 | 9/1989 | Tanaka et al. | 430/572 |
| 5,362,616 | 11/1994 | Edwards et al. | 430/356 |
| 5,418,116 | 5/1995 | Gottschalk et al. | 430/370 |

FOREIGN PATENT DOCUMENTS

| | | |
|---|---|---|
| 3-105341 | 5/1991 | Japan . |
| WO 93/12465 | 6/1993 | WIPO . |

*Primary Examiner*—Thorl Chea

*Attorney, Agent, or Firm*—Flynn, Thiel, Boutell & Tanis, P.C.

[57] ABSTRACT

A silver halide photographic material is provided which exhibits nearly equal sensitivities and gamma values with respect to yellow, magenta and cyan to form a black-and-white image of neutral black or sepia tone, even when it is processed with a color developer free from benzyl alcohol.

The silver halide photographic material is made up of a substrate and at least one silver halide emulsion layer formed on the substrate. The silver chloride content of silver halide grains constituting the silver halide emulsion layer is 95 mole % or above, the silver halide emulsion is spectrally sensitized by a specific sensitizing dye, and the silver halide emulsion layer contains a yellow coupler, a magenta coupler and a cyan coupler. The image-forming process is characterized by developing the silver halide photographic material with a color developer substantially free from benzyl alcohol.

9 Claims, No Drawings

SILVER HALIDE PHOTOGRAPHIC MATERIAL AND IMAGE-FORMING PROCESS

BACKGROUND OF THE INVENTION

The present invention relates to a silver halide photographic material and an image-forming process, particularly a black-and-white photographic material using dye images which can be processed with a color developer substantially free from benzyl alcohol and an image-forming process using the material.

PRIOR ART

In ordinary current black-and-white photography, a black-and-white photographic material is processed with a black-and-white developer to form a silver image, thus giving a black-and-white photograph of neutral black tone. Alternatively, the silver image is subjected to toning to give a black-and-white image of sepia tone. Meanwhile, it is also known that a multilayer color photographic material containing a yellow coupler in the regular layer, a magenta coupler in the orthochromatic layer and a cyan coupler in the panchromatic layer can give a black-and-white image by correction with filters.

However, a black-and-white photograph using a silver image is not contributory to the conservation of resources, because the photograph itself requires silver. On the other hand, the formation of a black-and-white image using a multilayer color photographic material has a disadvantage in that the tones of the sensitive layers are not in full accord with each other and fail in forming a black-and-white image exhibiting a well-balanced tone over the whole area ranging from a low-density area to a high-density one. Further, a color developer using benzyl alcohol is environmentally undesirable. Additionally, the color photographic material has another disadvantage in that in the case of using a color negative film as a negative original, the tone of the negative original cannot be faithfully reproduced because the sensible wavelength region of the material does not cover the whole wavelength region of visible light.

WO93/12465 and JP-A-3-105341 (CA Abstract No.: 115 (20)218762Q) disclose a silver halide photographic material for black and white images comprising silver halide grains and a yellow coupler, a magenta coupler and a cyan coupler.

SUMMARY OF THE INVENTION

A first object of the present invention is to form a black-and-white photograph of neutral black or sepia tone by using dye images to thereby enable the re-use of silver.

A second object of the present invention is to provide the processing of a photographic material with a color developer substantially free from benzyl alcohol to thereby contribute to environmental protection.

A third object thereof is to form a black-and-white photograph of neutral black or sepia tone exhibiting a well-balanced tone over the whole area ranging from a low-density one to a high-density one.

A fourth object thereof is to form a black-and-white photograph wherein the tone of a color negative film is reproduced faithfully.

The above objects of the present invention can be attained by a silver halide photographic material comprising a substrate and at least one silver halide emulsion layer formed on the substrate, characterized in that the silver chloride content of the silver halide grains constituting the silver halide emulsion layer is 95 mole % or above, the silver halide emulsion is spectrally sensitized by at least one sensitizing dye represented by the formula (I), at least one sensitizing dye represented by the formula (II) and/or at least one sensitizing dye represented by the formula (III) or (IV), and the silver halide emulsion layer contains a yellow coupler, a magenta coupler and a cyan coupler, and an image-forming process characterized by developing the silver halide photographic material with a color developer substantially free from benzyl alcohol.

Formula (I)

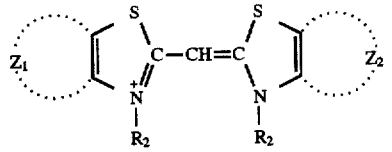

$(X_1^-)_{p_1-1}$ wherein $R_1$ and $R_2$ are each $C_1$–$C_6$ alkyl, $C_1$–$C_4$ substituted alkyl or aralkyl; $Z_1$ and $Z_2$ are each a non-metallic atomic group necessary for forming a benzene or naphthalene nucleus; $X_1$ is an anionic group; and $p_1$ is 1 or 2, with the proviso that when $p_1$ is 1, an inner salt is formed.

Formula (II)

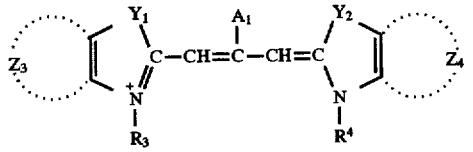

$(X_2^-)_{p_2-1}$ wherein $R_3$ and $R_4$ are each optionally sulfonated $C_1$–$C_6$ alkyl; $A_1$ is hydrogen, $C_1$–$C_3$ alkyl, or aryl; $Y_1$ and $Y_2$ are each sulfur, oxygen, selenium or N—$R_5$ with $R_5$ being $C_1$–$C_3$ alkyl; $Z_3$ and $Z_4$ are each a non-metallic atomic group necessary for forming a benzene or naphthalene nucleus; $X_2$ is an anion; and $p_2$ is 1 or 2, with the proviso that when $p_2$ is 1, an inner salt is formed.

Formula (III)

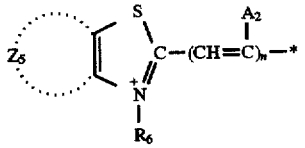

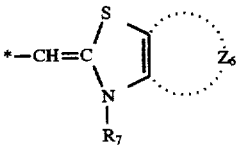

$(X_3^-)_{p_3-1}$

Formula (IV)

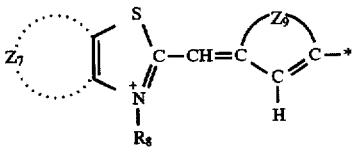

-continued

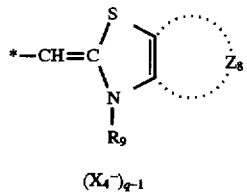

wherein $R_6$, $R_7$, $R_8$ and $R_9$ are each $C_1$–$C_6$ alkyl, $C_1$–$C_4$ substituted alkyl or aralkyl; $A_2$ is hydrogen, $C_1$–$C_3$ alkyl or aryl; $Z_5$, $Z_6$, $Z_7$ and $Z_8$ are each a non-metallic atomic group necessary for forming a benzene or naphthalene nucleus; $Z_9$ is an atomic group necessary for forming a six-membered ring; $X_3$ and $X_4$ are each an anionic group; n is 2; and $p_3$ and q are each 1 or 2, with the proviso that when $p_3$ and q are 1, an inner salt is formed.

The invention provides a silver halide photographic material comprising a supporting substrate and at least one silver halide emulsion layer formed on the substrate, said emulsion layer comprising silver halide grains including 95 mole % or above of silver chloride and a yellow coupler, a magenta coupler and a cyan coupler, and is spectrally sensitized by at least one selected from the group consisting of sensitizing dyes having the formulae (I), (II), (III) and (IV) defined above.

It is preferable that the emulsion is spectrally sensitized by sensitizing dyes having the formulae (I), (II) and (III), respectively, in combination, or alternatively by those having the formulae (I), (II) and (IV), respectively, in combination.

The invention further provides an image-forming process comprising the step of developing the silver halide photographic material as defined above with a color developer substantially free from benzyl alcohol.

DETAILED DESCRIPTION OF THE INVENTION

A preferable silver halide emulsion to be used in the present invention comprises at least 95 mole % of silver chloride, and more preferable, is silver chlorobromide which is substantially free from silver iodide.

The mean grain size of the silver halide grains is preferably 3 μm or below (in terms of mean grain diameter with respect to spherical or approximately spherical grains or mean edge length with respect to cubic grains, and based on projected area), though it is not particularly limited.

The grain size distribution of the silver halide grains does not matter and can be narrow or wide.

The silver halide grain may have a regular crystal form such as a cube or octahedron, an irregular crystal form such as a sphere or flake, or a composite of two or more of these crystal forms. Further, it may be composed of grains of various crystal forms.

Furthermore, the silver halide emulsion may be one wherein silver halide flakes having a diameter which is at least 5 times the thickness thereof occupy at least 50% of the whole projected area.

The silver halide grain may be one which forms latent images mainly on the surface thereof or one which forms latent images mainly in the inside thereof.

The silver halide grain may have a layered structure composed of inner and outer layers which are different from each other in the composition of the halide. Further, silver halide grains of different halide compositions may be epitaxially junctioned with each other.

The silver halide grain constituting the silver halide emulsion is preferably one composed of grains characterized in that a localized silver halide layer having a silver bromide content of 30 to 60 mole % is formed by epitaxial growth locally on the surface of each grain, particularly at the corner thereof. It is still preferable that the amount of silver constituting the localized layer account for 0.5 to 5% of the total amount of silver constituting the silver halide grain. A process for producing these epitaxial silver halide grains is described in EP 273,430 A.

The silver halide emulsion to be used in the present invention can be prepared by the processes described in P. Glafkides, "Chimie et Physique Photographique" (Paul Montel, 1967), G. F. Duffin, "Photographic Emulsion Chemistry" (The Focal Press, 1966), V. L. Zelikman et al., "Making and Coating Photographic Emulsion" (The Focal Press, 1964) and so on. In other words, the silver halide emulsion may be prepared by any of the acid processes, the neutral processes and the ammonia processes, and the reaction of a soluble silver salt with a soluble halide salt may be conducted by any of the cocurrent, countercurrent and simultaneous mixing processes or a combination of two or more of these processes.

The so-called "controlled double-jet process", which is characterized in that the pAg of the solution forming the silver halides is kept at a constant level, can be employed as one of the simultaneous mixing processes. The employment of this process gives silver halide grains having a regular crystal form and nearly uniform grain sizes.

A mixture of two or more silver halide emulsions which have separately been prepared may also be used.

One or more members selected from among cadmium salts, zinc salts, lead salts, thallium salts, iridium salts and complex salts thereof, rhodium salts and complex salts thereof, iron salts and complex salts thereof and so on may be allowed to coexist in the step of forming silver halide grains or the step of physically ripening them.

In general, the silver halide emulsion is chemically sensitized. The chemical sensitization may be conducted by sulfur sensitization using activated gelatin or a sulfur-containing compound reactive with silver (which is selected from among thiosulfate salts, thioureas, mercapto compounds, rhodanines and so on), reduction sensitization using a reducing substance (which is selected from among stannous salts, amines, hydrazine derivatives, formamidine sulfinate, silane compounds and so on), noble metal sensitization using a noble metal compound (which is selected from among complex salts of gold, platinum, iridium, palladium and so on), or a combination of two or more of them.

The silver halide emulsion of the present invention can be spectrally sensitized by at least one sensitizing dye represented by the formula (I), at least one sensitizing dye represented by the formula (II), and/or at least one sensitizing dye represented by the formula (III) or (IV).

In the formula (I), $R_1$ and $R_2$ are each $C_1$–$C_6$ alkyl (such as methyl, ethyl, n-propyl, isopropyl, n-butyl , isobutyl, n-hexyl , isohexyl or the like), $C_1$–$C_4$ substituted alkyl [for example, hydroxyalkyl (such as 2-hydroxyethyl, 3-hydroxypropyl, 2-hydroxypropyl or the like), sulfoalkyl (such as 2-sulfoethyl, 3-sulfopropyl , 3-sulfobutyl, 4-sulfobutyl or the like), carboxyalkyl (such as 2-carboxyethyl, 3-carboxypropyl, 3-carboxybutyl, 4-carboxybutyl or the like)], or aralkyl (such as benzyl, 2-phenylethyl or the like), with the case wherein either of $R_1$ and $R_2$ is substituted alkyl being preferable; $Z_1$ and $Z_2$ are each a non-metallic atomic group necessary for forming a benzene or naphthalene nucleus which may have a substituent (for example, halogen, alkyl , alkoxy, aryl, cyano, alkoxycarbonyl, trifluoromethyl, alkylsulfonyl, alkylsulfamoyl , acylamino, alkylcarbamoyl , acetoxy or the like); $X_1$ is a conventionally used anionic group (for example, chloride ion, bromide ion, iodide ion, perchlorate ion, p-toluenesulfonate ion, ethylsulfate ion or the like); and $p_1$ is 1 or 2, with the proviso that when $p_1$ is 1, an inner salt is formed.

Specific examples of the sensitizing dye represented by the general formula (I) will now be described.

I-1

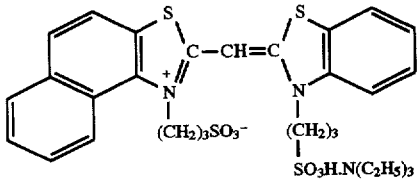

I-2

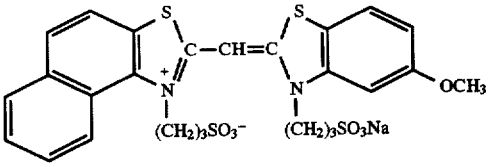

I-3

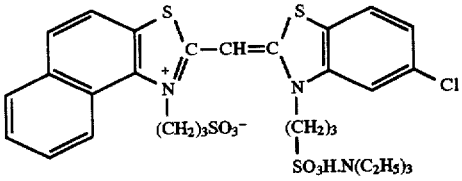

I-4

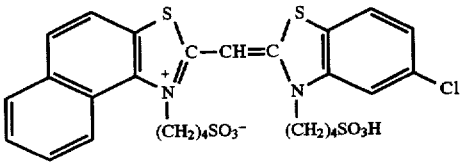

I-5

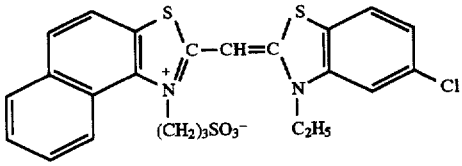

I-6

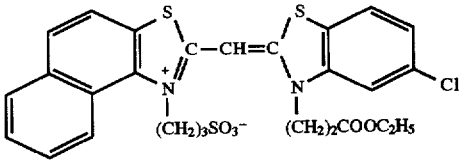

I-7

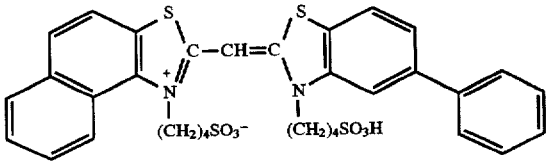

-continued

I-8

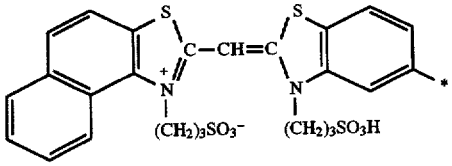

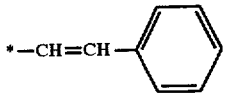

I-9

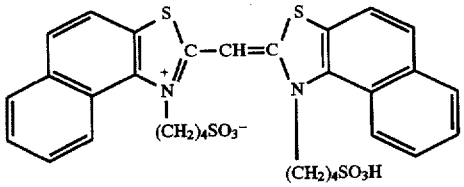

I-10

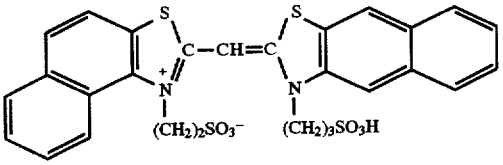

I-11

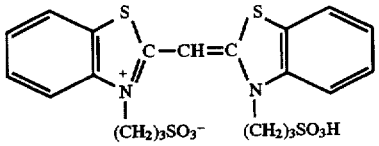

I-12

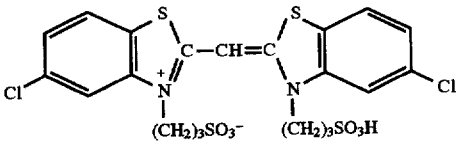

I-13

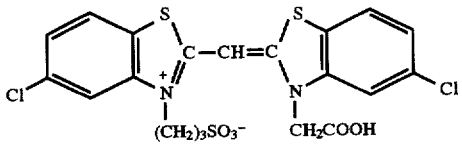

I-14

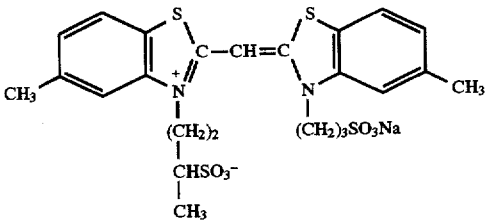

I-15

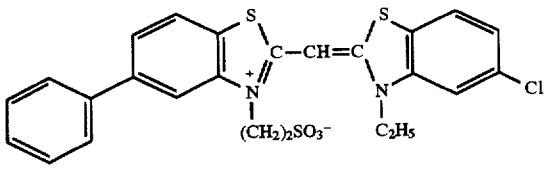

I-16

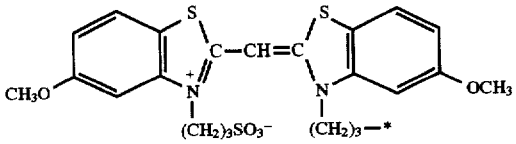

-continued

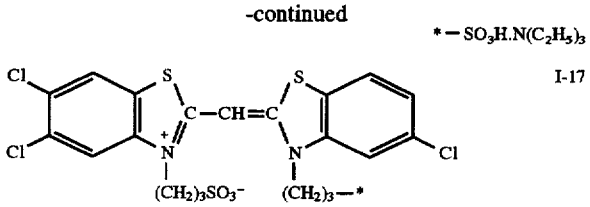

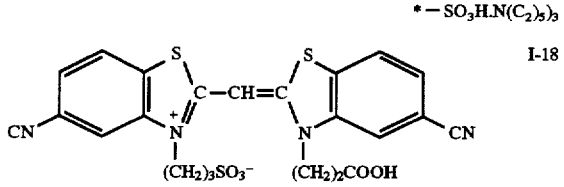

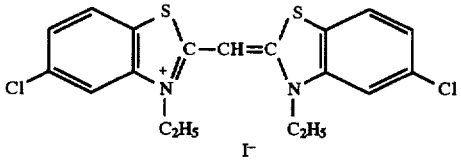

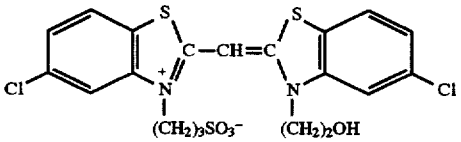

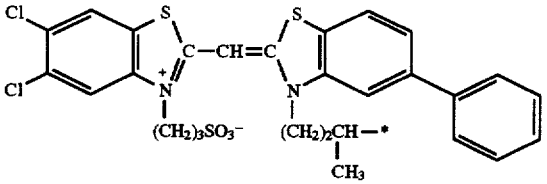

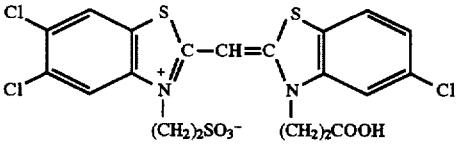

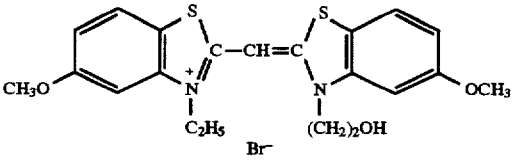

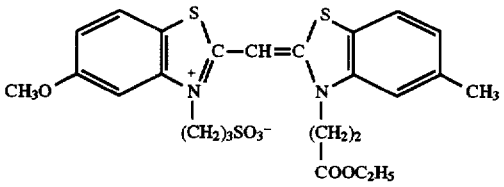

In the formula (II), $R_3$ and $R_4$ are each optionally sulfonated $C_1$–$C_6$ alkyl (such as methyl, ethyl, n-propyl, isopropyl, n-butyl, isobutyl, n-hexyl, 2-sulfoethyl, 3-sulfopropyl, 3-sulfobutyl or the like); $A_1$ is hydrogen, $C_1$–$C_3$ alkyl (such as methyl, ethyl, n-propyl, isopropyl or the like) or aryl (such as phenyl or the like); $Y_1$ and $Y_2$ are each sulfur, oxygen, selenium or N—$R_5$, with $R_5$ being $C_1$–$C_3$ alkyl (such as methyl, ethyl, n-propyl, isopropyl or the like); $Z_3$ and $Z_4$ are each a non-metallic atomic group necessary for forming a benzene or naphthalene ring which may have a substituent (for example, halogen, alkyl, alkoxy, aryl, carbonyl, alkoxycarbonyl, cyano or the like); $X_2$ is an anionic group (such as chloride ion, bromide ion, iodide ion, perchlorate ion, p-toluenesulfonate ion, ethylsulfate ion or the like); and $p_2$ is 1 or 2, with the proviso that when $p_2$ is 1, an inner salt is formed.

Specific examples of the sensitizing dye represented by the formula (II) will now be described.

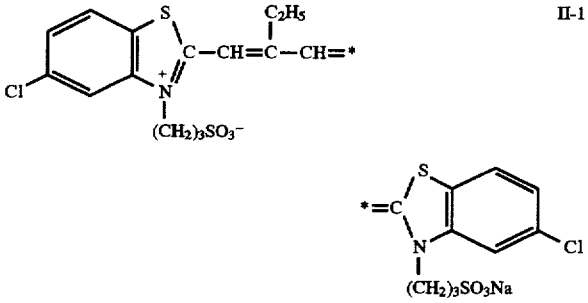

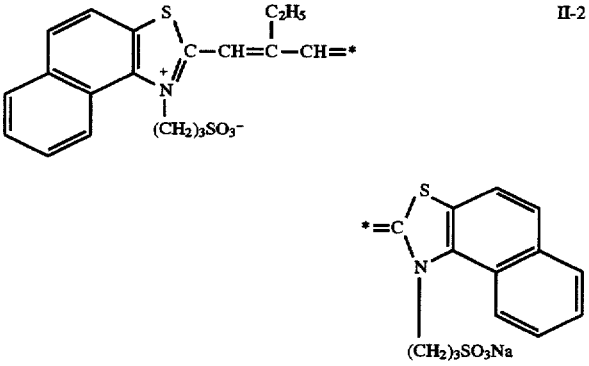

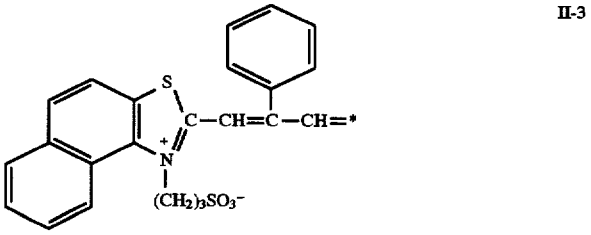

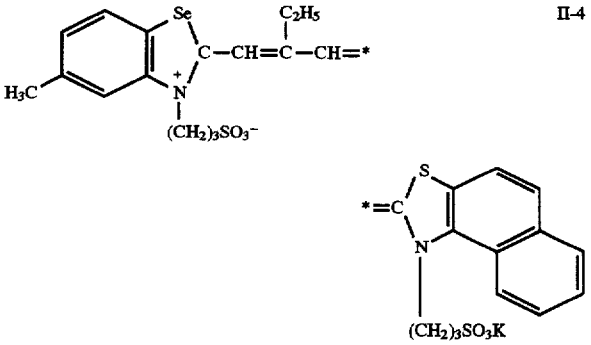

-continued
II-5
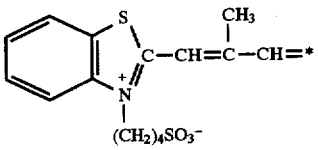
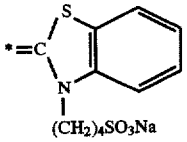
II-6
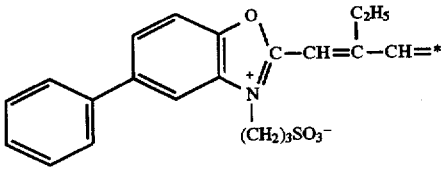
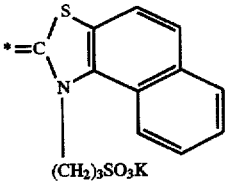
II-7
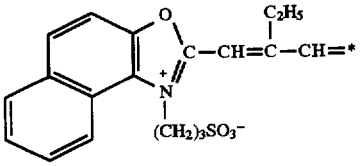
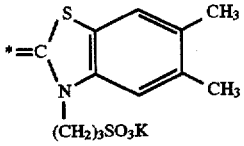
II-8
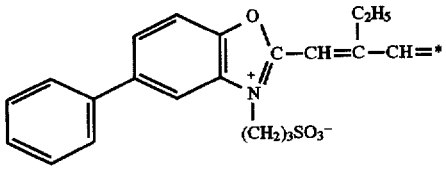
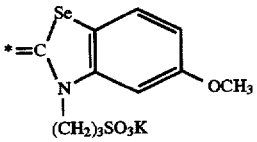
II-9
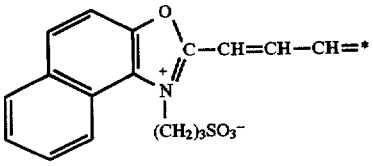
-continued
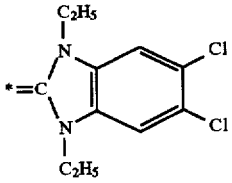
II-10
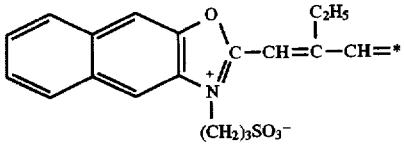
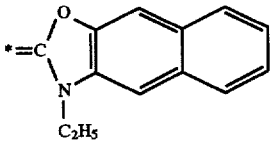
II-11
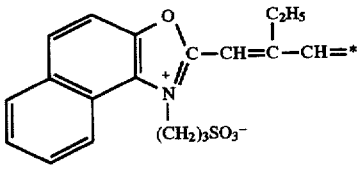
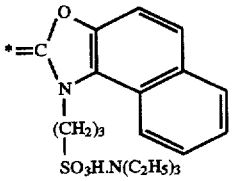
II-12
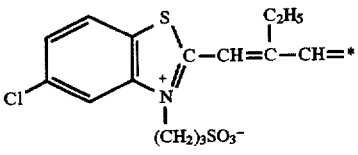
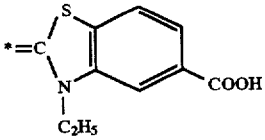
II-13
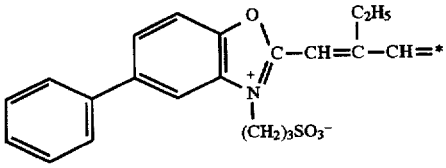
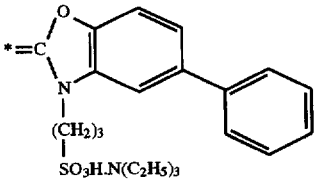

-continued

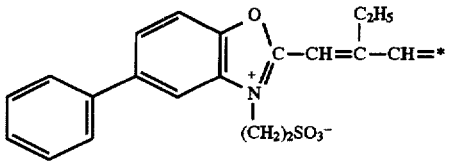

II-14

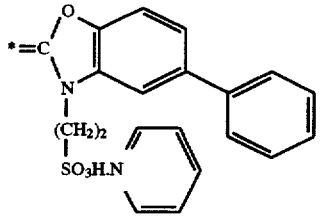

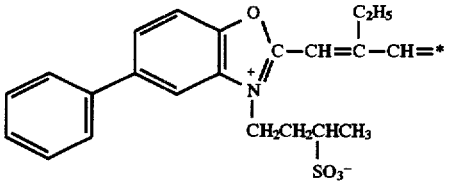

II-15

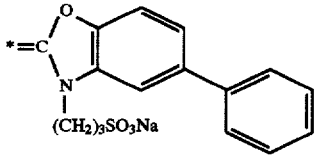

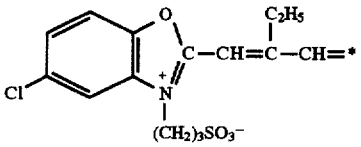

II-16

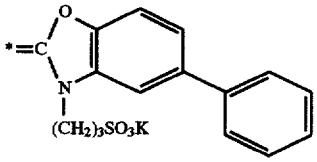

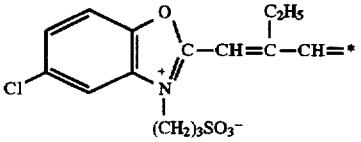

II-17

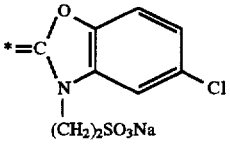

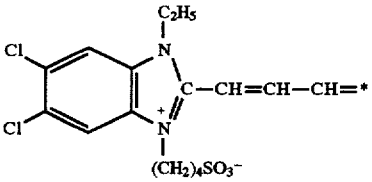

II-18

-continued

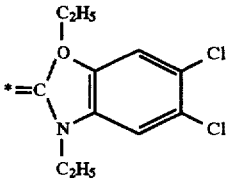

II-19

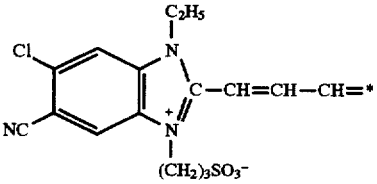

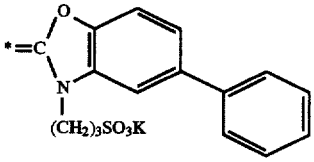

II-20

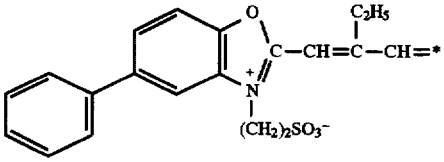

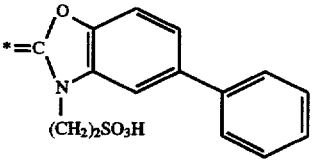

In the formulae (III) and (IV), $R_6$, $R_7$, $R_8$ and $R_9$ are each $C_1$–$C_6$ alkyl (such as methyl, ethyl, n-propyl, isopropyl, n-butyl, isobutyl, n-hexyl, isohexyl or the like), $C_1$–$C_4$ substituted alkyl [for example, hydroxyalkyl (such as 2-hydroxyethyl, 3-hydroxypropyl, 2-hydroxypropyl or the like), sulfoalkyl (such as 2-sulfoethyl, 3-sulfopropyl, 3-sulfobutyl, 4-sulfobutyl or the like) or carboxyalkyl (such as 2-carboxyethyl, 3-carboxypropyl, 3-carboxybutyl, 4-carboxybutyl or the like)] or aralkyl (such as benzyl, 2-phenylethyl or the like), with the case wherein either of $R_6$ and $R_7$ is substituted alkyl and the case wherein either of $R_8$ and $R_9$ is substituted alkyl being preferable; $A_2$ is hydrogen, $C_1$–$C_3$ alkyl (such as methyl, ethyl, n-propyl, isopropyl or the like) or aryl (such as phenyl or the like); $Z_5$, $Z_6$, $Z_7$ and $Z_8$ are each a non-metallic atomic group necessary for forming a benzene or naphthalene nucleus which may have a substituent (for example, halogen, alkyl, alkoxy, aryl, cyano, alkoxycarbonyl, trifluoromethyl, alkylsulfonyl, alkylsulfamoyl, acylamino, alkylcarbamoyl, acetoxy or the like); $Z_9$ is a non-metallic atomic group necessary for forming a six-membered nucleus which may have a substituent (such as alkyl or the like); $X_3$ and X are each an anionic group (such as chloride ion, bromide ion, iodide ion, perchlorate ion, p-toluene-sulfonate ion, ethylsulfate ion or the like); and $p_3$ and q are each 1 or 2, with the proviso that when each $p_3$ and q are 1, an inner salt is formed.

Specific examples of the sensitizing dye represented by the formula (III) or (IV) will now be described.

III-1
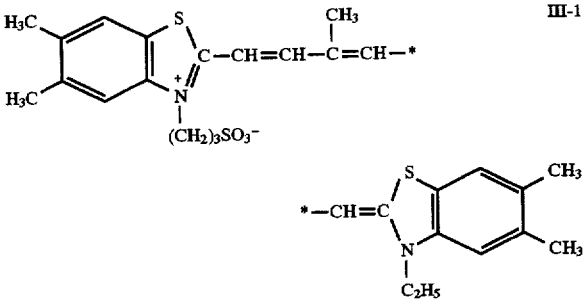
III-2
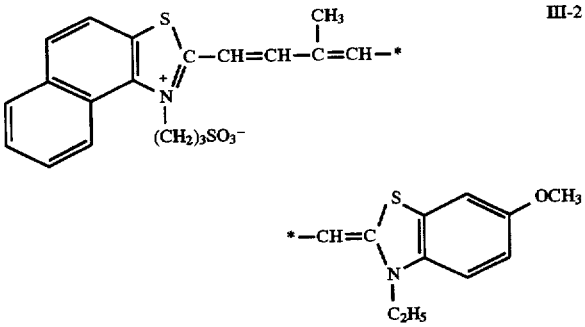
III-3
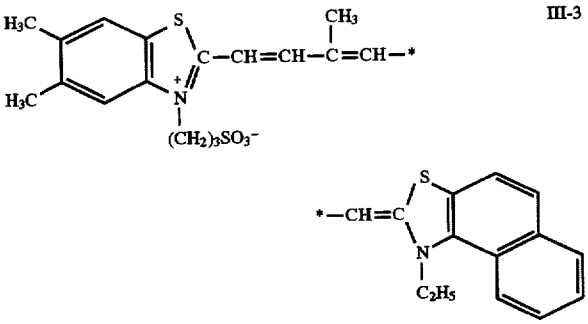
III-4
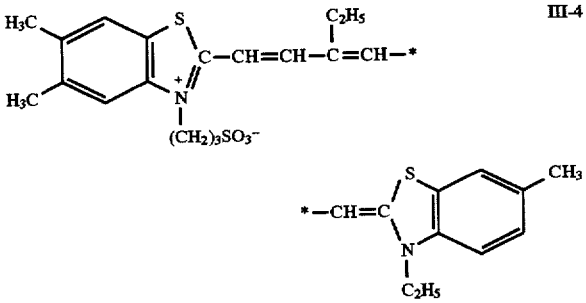
III-5
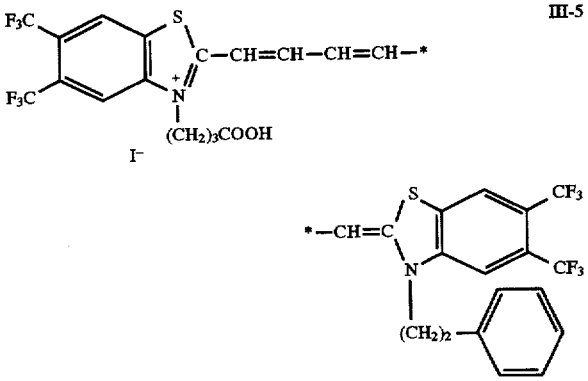
-continued
IV-1
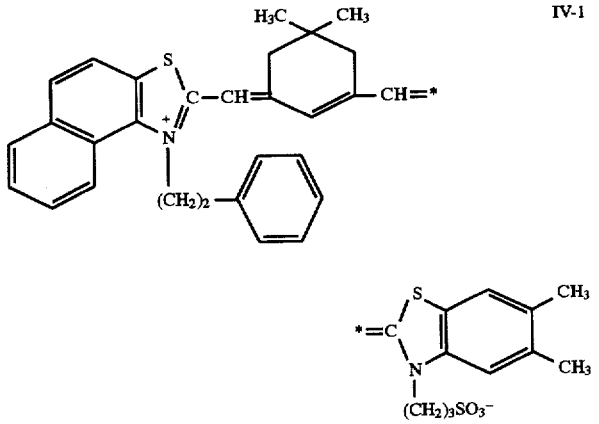
IV-2
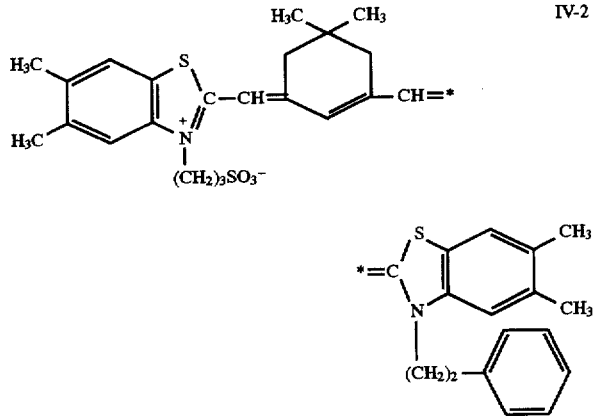
IV-3
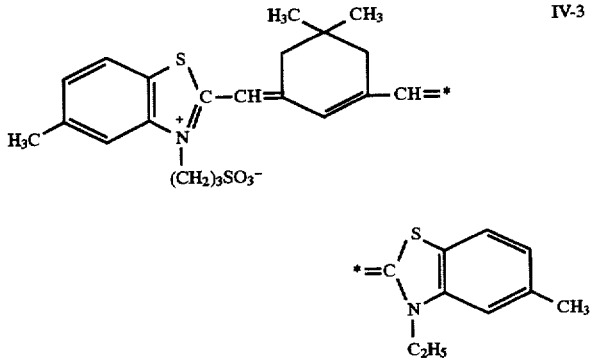
IV-4
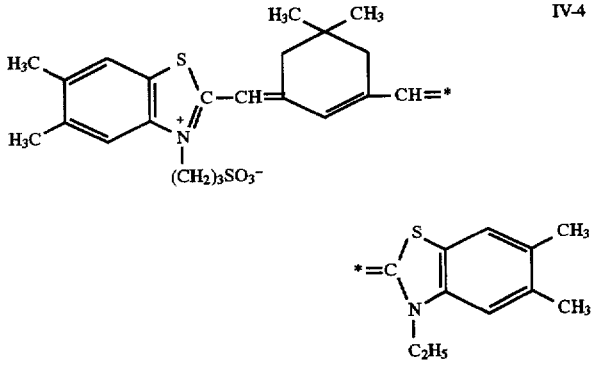

-continued

IV-5

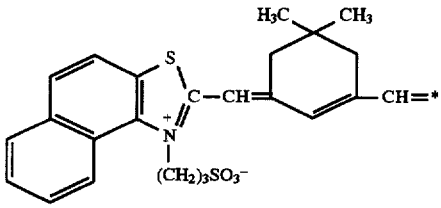

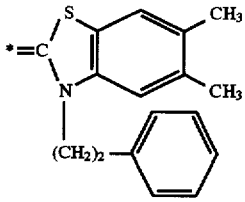

IV-6

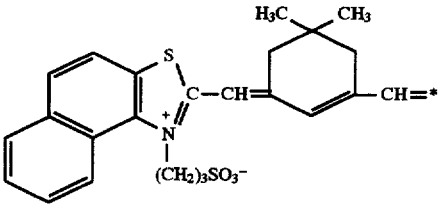

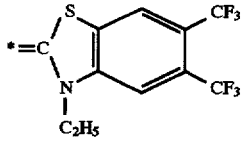

IV-7

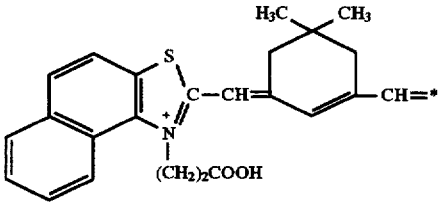

I⁻

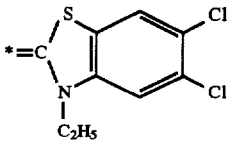

IV-8

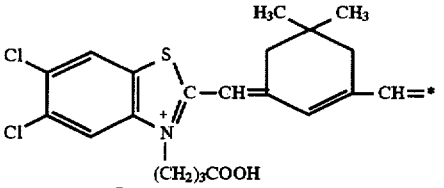

I⁻

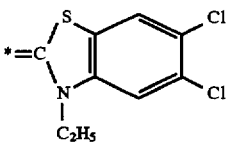

-continued

IV-9

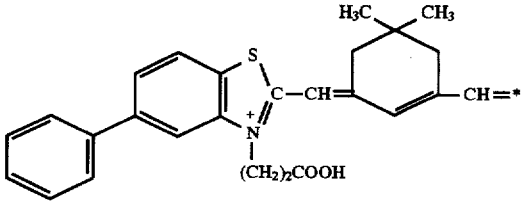

I⁻

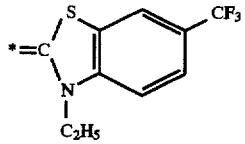

IV-10

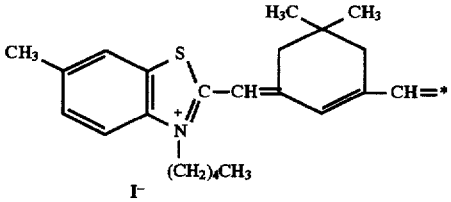

I⁻

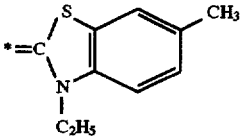

These sensitizing dyes can readily be prepared by the processes described in "Heterocyclic Compounds, Cyanine Dyes and Related Compounds".

These sensitizing dyes are used in a concentration of $10^{-6}$ to $10^{-3}$ mol per mol of the silver halide contained in the silver halide emulsion. In adding such a sensitizing dye to the silver halide emulsion, the sensitizing dye may be dispersed directly in the silver halide emulsion or it may be dispersed therein in a state dissolved in a suitable solvent such as methyl alcohol, ethyl alcohol, acetone, N,N-dimethylformamide, ethyl acetate or a mixture of two or more of them or a solution of a surfactant in such a solvent.

The sensitizing dye can be added to the silver halide emulsion during the formation of silver halide grains or after the completion of physical ripening. It is preferable that the sensitizing dye be added to the silver halide emulsion after the completion of physical ripening and before, during or after chemical ripening. Each of the above sensitizing dyes may be used alone or as a mixture of two or more of them. Such a mixture is often used particularly for the purpose of supersensitization.

The emulsion may contain a dye exhibiting no spectral sensitization effect in itself or a substance by which scarcely any visible light is absorbed and which exhibits a supersensitization effect, in addition to the sensitizing dye. For example, it may contain an aminostyryl compound substituted with a nitrogen-containing heterocyclic group (as described in, e.g., U.S. Pat. Nos. 2,933,390 or 3,635,721), an aromatic organic acid-formaldehyde condensate (as described in, e.g., U.S. Pat. No. 3,743,510), a cadmium salt, an azaindene compound or the like.

The yellow coupler usable in the present invention includes oil-protected acylacetamide couplers. Specific examples thereof are described in, e.g., U.S. Pat. No. 2,407,210, 2,875,057 and 3,265,506. The use of a two-equivalent yellow coupler is preferable in the present invention. Such a two-equivalent yellow coupler includes oxygen atom leaving ones as described in, e.g., U.S. Pat. No. 3,408,194, 3,447,928, 3,933,501 and 4,401,752; and nitrogen atom leaving ones as described in, e.g., JP-B-58-10739, U.S. Pat. No. 4,022,620 and 4,326,024, Research Disclosure 18,053 (April, 1987), GB 1,425,020, and DE 2,219,917 A1, 2,261,361 A1, 2,329,587 A1 and 2,433,812 A1.

α-Pivaloylacetanilide type couplers are characterized by the fastnesses of formed dyes, while α-benzoylacetanilide type ones are characterized by excellent coupling properties.

The magenta coupler usable in the present invention includes oil-protected indazolone and cyanoacetyl couplers, with preferable examples thereof including 5-pyrazolone type couplers and pyrazoloazole type couplers such as pyrazolotriazole type ones. Among 5-pyrazolone couplers, those which are substituted with arylamino or acylamino at position 3 are preferable from the standpoints of the hue of formed dyes and the rate of coupling. Specific examples of such 5-pyrazolone couplers include those as described in U.S. Pat. No. 2,311,082, 2,343,703, 2,600,788, 2,908,573, 3,062,653, 3,152,896 and 3,936,015. The use of a two-equivalent 5-pyrazolone coupler is particularly preferable and the leaving group includes nitrogen atom leaving ones as described in U.S. Pat. No. 4,310,619 and arylthio groups as described in U.S. Pat. No. 4,351,897. A 5-pyrazolone coupler having a ballast group as described in EP 73,636 exhibits a high coupling reactivity, being preferable. The pyrazoloazole couplers include pyrazolo[1,5-b]-[1,2,4] triazoles described in EP 119,860, pyrazolobenzimidazoles described in U.S. Pat. No. 3,369,897, pyrazolotetrazoles described in Research Disclosure 24,220 (June, 1984), and pyrazolopyrazoles described in Research Disclosure 24,230 (June, 1984). Further, imidazopyrazoles and pyrazolo[1,5-b][1,2,4]triazoles described in JP-A-59-162548 are preferable, because the formed dye hardly causes secondary absorption of yellow and is excellent in lightfastness.

The cyan coupler usable in the present invention includes oil-protected naphthol and phenol couplers. Examples of the naphthol couplers include those described in U.S. Pat. No. 2,474,293, preferably oxygen atom leaving highly active two-equivalent ones as described in U.S. Pat. No. 4,052,212, 4,143,396, 4,228,233 and 4,296,200. Examples of the phenol couplers include those described in U.S. Pat. No. 2,369,929, 2,423,730, 2,772,162, 2,801,171, 2,895,826 and so on. It is preferable to use a cyan coupler with a fastness to temperature and humidity. Examples of such a cyan coupler include phenolic cyan couplers described in US 3,772,022; 2,5-diacylamino-substituted phenol couplers described in U.S. Pat. No. 2,772,162, 3,758,308, 4,126,396 and 4,327,137 and JP-A-59-166956; and 2-phenylureido-5-acylaminophenol couplers described in U.S. Pat. No. 3,446,622, 4,333,999, 4,451,559, 4,427,767 and so on.

Specific examples of the couplers used in the present invention will now be described.

C-1

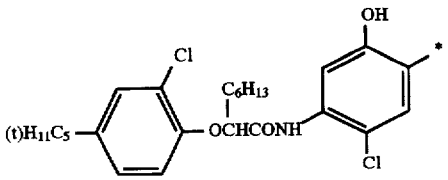

-continued

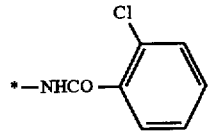

C-2

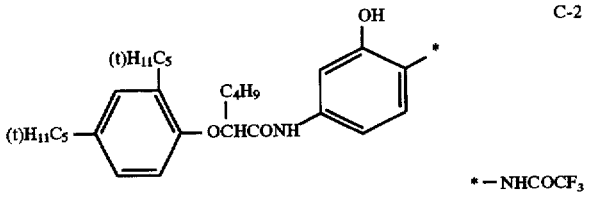

C-3

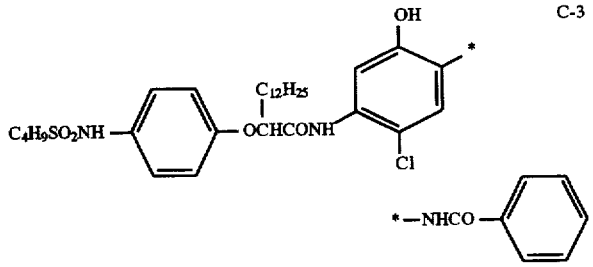

C-4

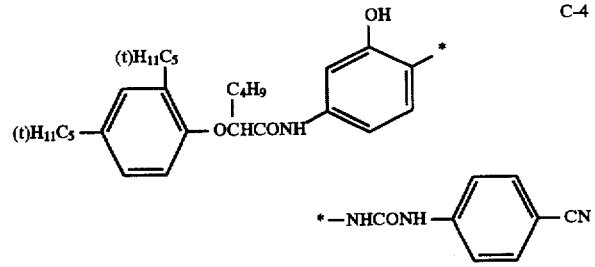

C-5

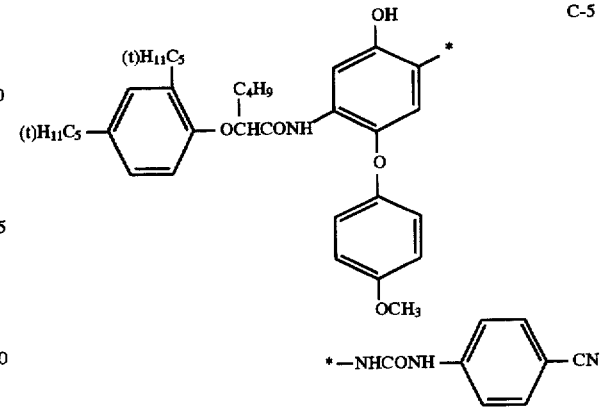

C-6

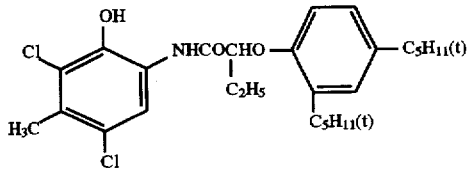

C-7

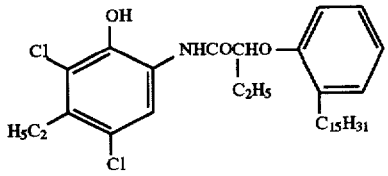

-continued
C-8
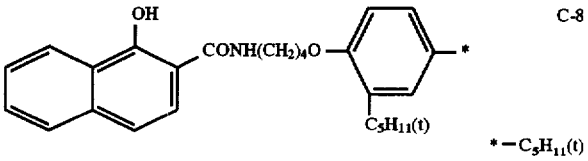
C-9
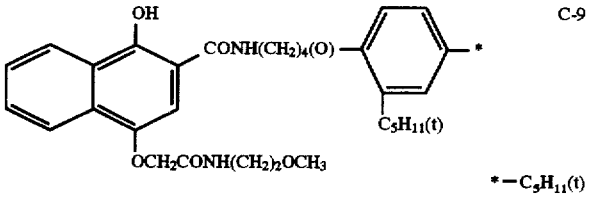
C-10
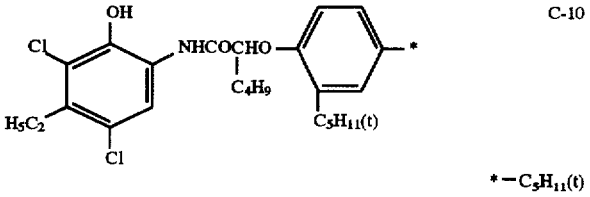
C-11
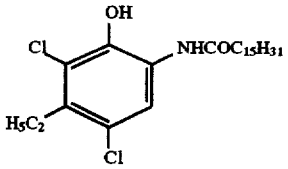
C-12
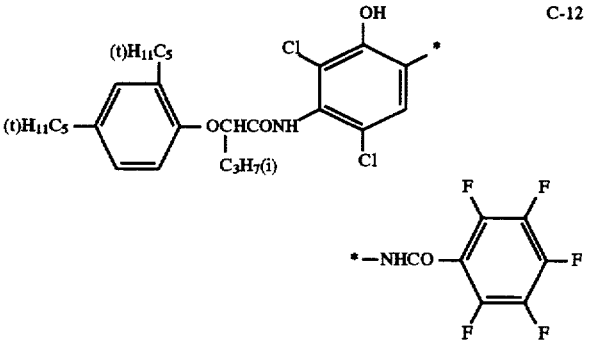
M-1
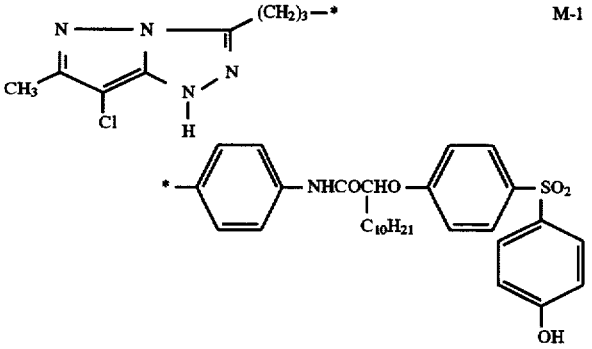
M-2
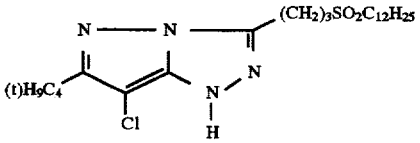
-continued
M-3
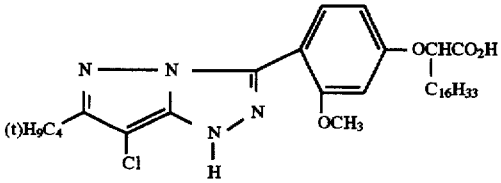
M-4
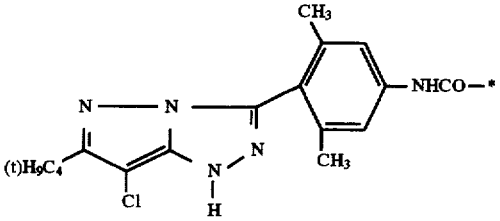
M-5
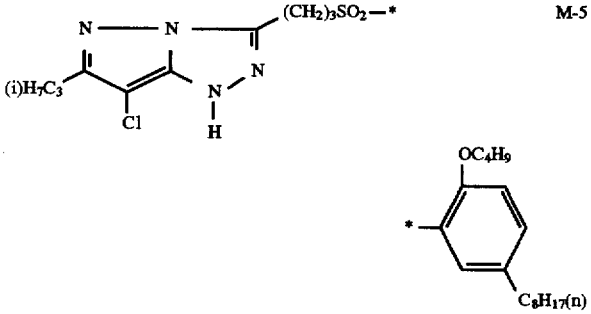
M-6
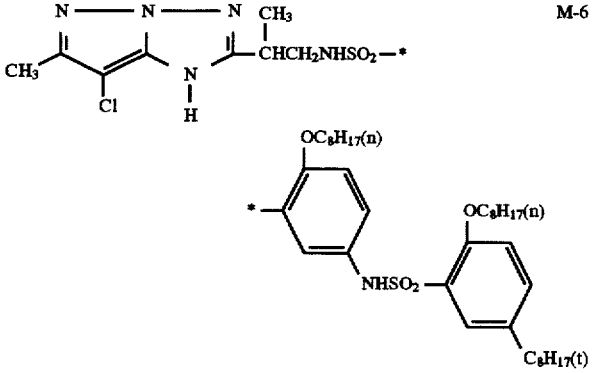
M-7
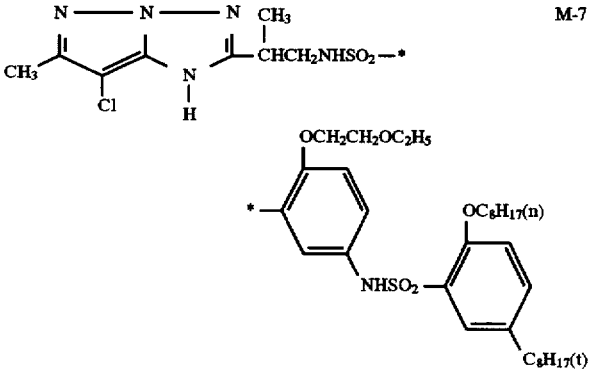
M-8
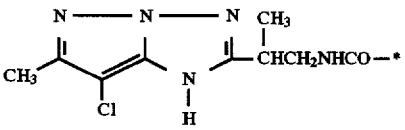

-continued
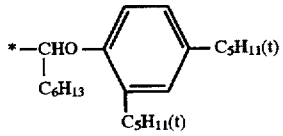
M-9
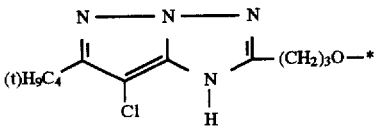
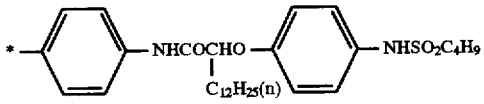
M-10
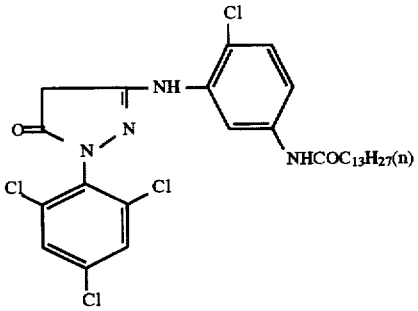
M-11
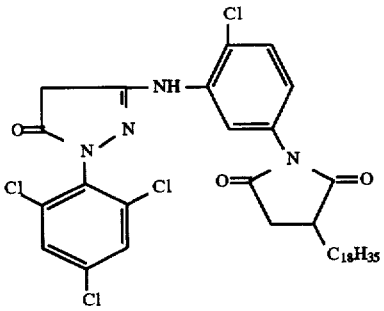
M-12
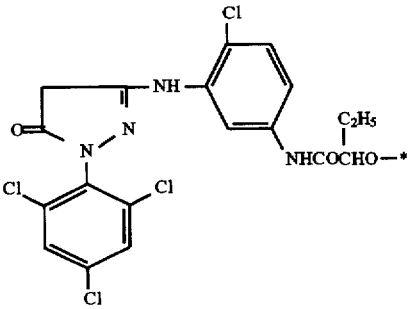
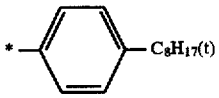
-continued
M-13
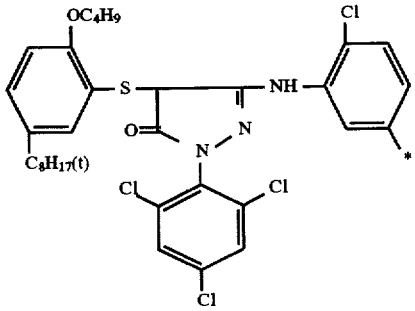
$*-NHCOC_{13}H_{27}(n)$
M-14
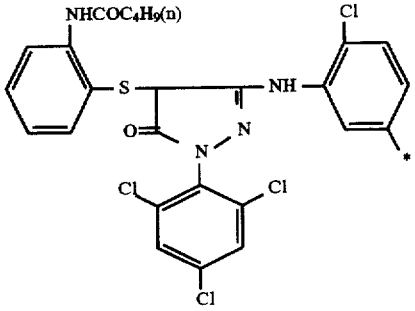
$*-NHCOC_{13}H_{27}(n)$
M-15
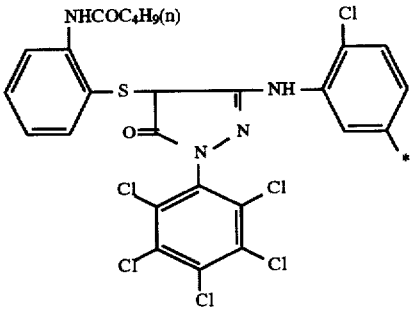
$*-NHCOC_{15}H_{31}$
M-16
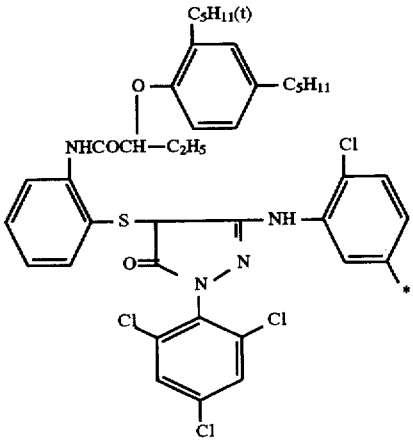
$*-SO_2C_{12}H_{25}(n)$ -continued
M-17
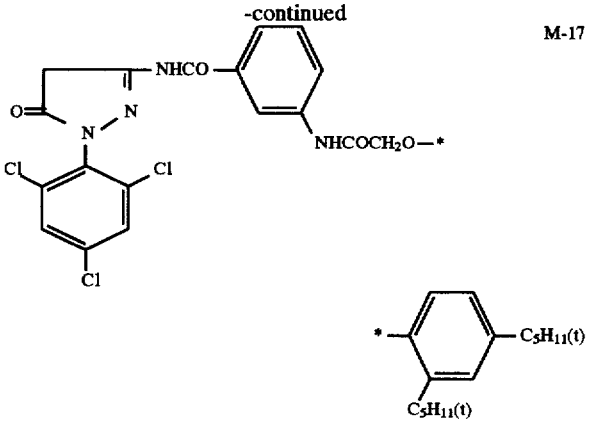
M-18
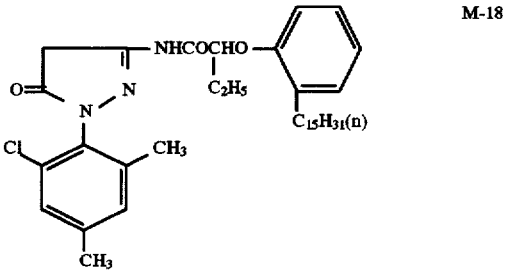
Y-1
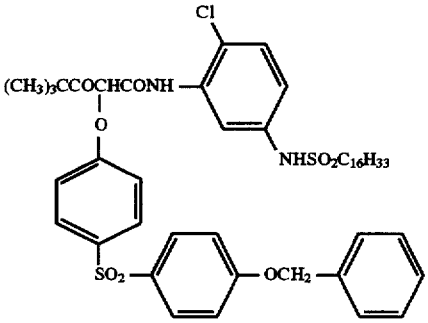
Y-2
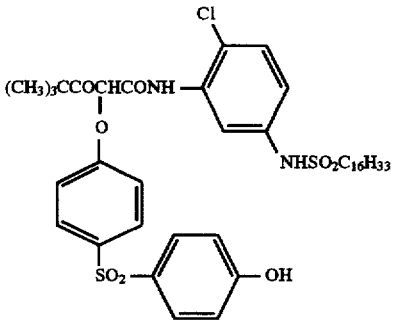
Y-3
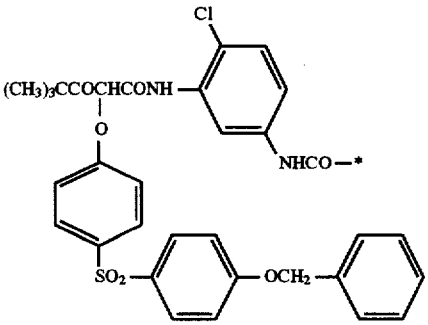
-continued
Y-4
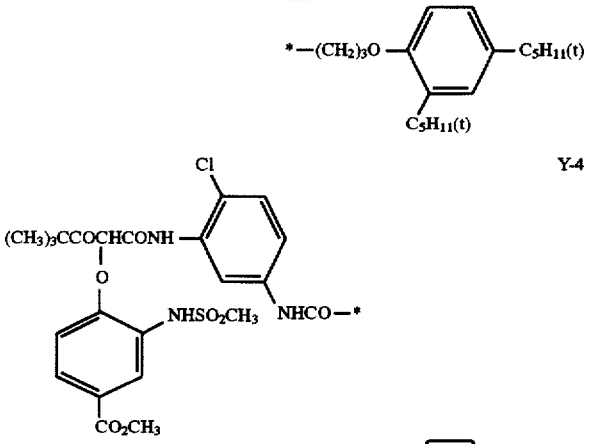
Y-5
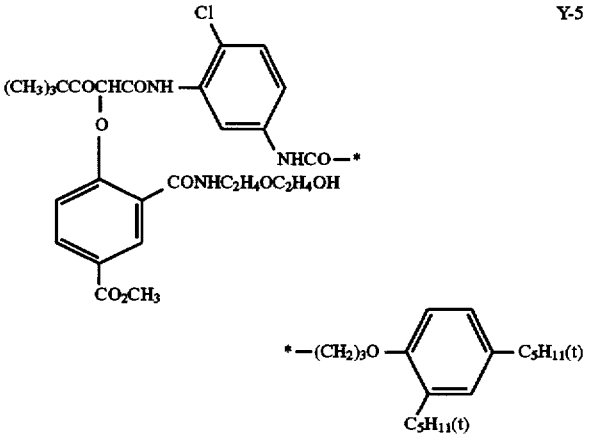
Y-6
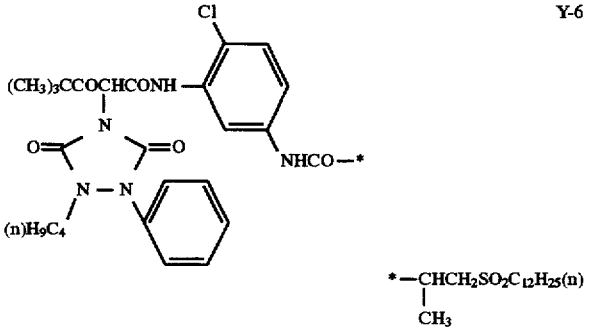
Y-7
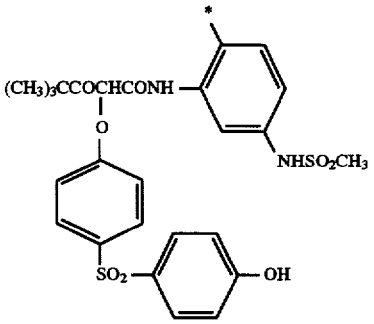

-continued

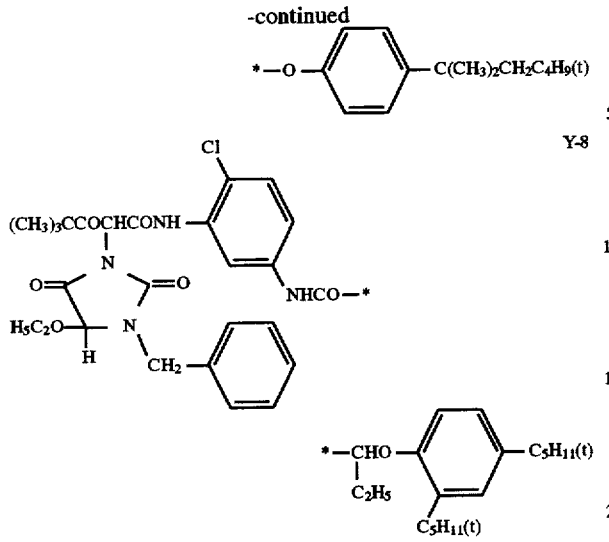

Y-8

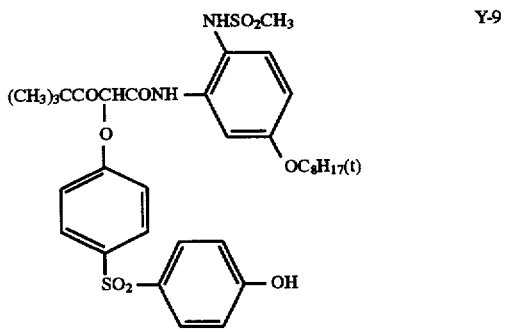

Y-9

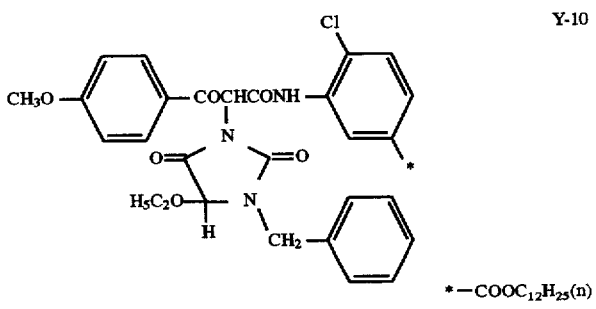

Y-10

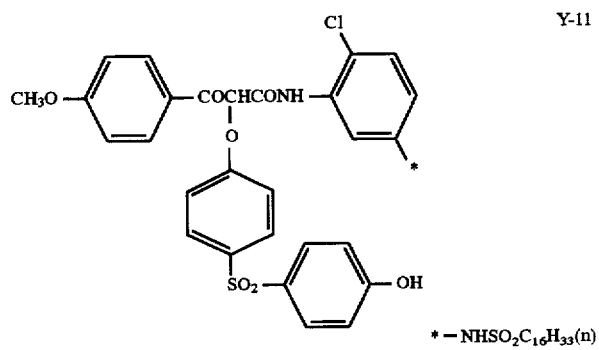

Y-11

The couplers used in the present invention can be introduced into the silver halide emulsion by various dispersion processes. Specifically, the introduction can be conducted by, e.g., the solid dispersion process, alkali dispersion process, preferably the latex dispersion process, and more preferably the oil-in-water dispersion process. According to the oil-in-water dispersion process, the couplers are dissolved in either of a high-boiling organic solvent having a boiling point of 175° C. or above or a low-boiling co-solvent or a mixture of both; and the resulting solution is finely dispersed in an aqueous medium such as water or an aqueous solution of gelatin in the presence of a surfactant. The high-boiling organic solvent may be selected from among those described in U.S. Pat. No. 2,322,027 and so on. The dispersion may be accompanied with phase inversion. If necessary, the resulting emulsion may be freed from the co-solvent or reduced in content of the co-solvent by distillation, noodle washing, ultrafiltration or the like prior to the application of the emulsion to a substrate.

In the silver halide photographic material of the present invention, it is preferable in order to obtain a hue of neutral black or sepia tone that a yellow coupler (Y), a magenta coupler (M) and a cyan coupler (C) be used at a Y/M/C molar ratio of 2 to 3 : 1 : 1.5 to 2.5.

Examples of the high-boiling organic solvent include phthalic acid esters (such as dibutyl phthalate, dicyclohexyl phthalate, di-2-ethylhexyl phthalate, didodecyl phthalate and so on); esters of phosphoric acid and phosphonic acid (such as triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexyl phenyl phosphate); benzoic acid esters (such as 2-ethylhexyl benzoate, dodecyl benzoate, 2-ethylhexyl p-hydroxybenzoate and so on); amides (such as diethyldodecanamide, N-tetradecylpyrrolidone and so on); alcohols and phenols (such as isostearyl alcohol, 2,4-di-t-amylphenol and so on); aliphatic carboxylic acid esters (such as dioctyl azelate, glycerol tributyrate, isostearyl lactate, trioctyl citrate and so on); aniline derivatives (such as N,N-dibutyl-2-butoxy-5-t-octylaniline and so on); hydrocarbons (such as paraffin, dodecylbenzene, diisopropylnaphthalene and so on); and so on.

The co-solvent may be one having a boiling point of about 30° to 60° C., and specific examples thereof include ethyl acetate, butyl acetate, ethyl propionate, methyl ethyl ketone, cyclohexanone, 2-ethoxyethyl acetate, dimethylformamide and so on.

The procedure and effects of the latex dispersion process and specific examples of the latex for impregnation are disclosed in U.S. Pat. No. 4,199,363 and DE 2,541,274 A1 and 2,51,230 A1.

The other listed compounds can also be prepared in similar manners to that described above.

Although gelatin is mainly used as the binder or protective colloid constituting the emulsion layer and other hydrophilic colloid layers of the photographic material according to the present invention, the binder or protective colloid may be selected from among proteins such as gelatin derivatives, albumin and casein; cellulose derivatives such as ethylcellulose and carboxymethylcellulose; saccharide derivatives such as starch derivatives; and hydrophilic homopolymers and copolymers such as polyvinyl alcohol, polyacrylic acid, polyacrylamide, polymethacrylic acid and so on.

The emulsion layer and other hydrophilic colloid layers constituting the photographic material according to the present invention may contain various compounds for the purpose of preventing fogging during production, storage or development, or stabilizing the photographic property. Such compounds include many compounds known as antifoggants or stabilizers, for example, azoles such as nitroindazoles, nitrobenzimidazoles, mercaptothiazoles, mercaptobenzimidazoles, mercaptothiadiazoles, aminotriazoles, benzotriazoles, mercaptotetrazoles (particularly 1-phenyl -5-mercaptotetrazoles), mercaptotriazines, thio ketone compounds, azaindenes such as triazaindenes, tetraazaindenes (particularly 4-hydroxy-1, 3, 3a, 7-tetraazaindenes), pentaazaindenes, benzenethiosulfonic acid, benzenesulfinic acid, benzenesulfonamide. Among these compounds, benzotriazoles and nitroindazoles are particularly preferable. These compounds may be added also to the processing bath to be used in development.

The emulsion layer and other hydrophilic colloid layers constituting the photographic material according to the present invention may contain a hydroquinone derivative, aminophenol derivative, gallic acid derivative, ascorbic acid derivative or the like as a color fog restrainer.

The emulsion layer and other hydrophilic colloid layers constituting the photographic material according to the present invention may contain an inorganic or organic hardening agent. Examples of the hardening agent include chromium salts (such as chrome alum); aldehydes (such as formaldehyde and glyoxal); N-methylol compounds, dioxane derivatives, active vinyl compounds (such as 1,2,5-triacryloyl-hexahydro-s-triazine and 1,3-vinylsulfonyl-2-propanol); active halogen compounds (such as 2,4-dichloro-6-hydroxy-s-triazine and so on); and mucohalogenoic acids (such as mucochloric acid and mucophenoxychloric acid), which each may be used alone or as a combination of two or more of them.

The emulsion layer and other hydrophilic colloid layers constituting the photographic material according to the present invention may contain surfactants for various purposes, for example, as a coating aid, antistatic agent, slip agent, emulsifier and dispersant, anti-blocking agent, photographic performance improver (such as development accelerator, contrasting agent and sensitizing agent) and so on. Examples of the surfactants include nonionic surfactants such as saponin, alkylene oxide derivatives (such as polyethylene glycol and polyethylene glycol alkyl ethers), glycidol derivatives (such as polyglycerides of alkenylsuccinic acids and polyglycerides of alkylphenols), fatty acid esters of polyhydric alcohols, alkyl esters of saccharides and so on; anionic surfactants having acid groups (such as carboxyl, sulfo, sulfuric ester and phosphoric ester) such as alkylcarboxylic acid salts, alkyl sulfate esters and alkyl phosphate esters; amphoteric surfactants such as amino acids, aminoalkylsulfonic acids, aminoalkylsulfuric acids, phosphoric esters and so on; and cationic surfactants such as aliphatic and aromatic quaternary ammonium salts, heterocyclic quaternary ammonium salts and so on.

The emulsion layer and other hydrophilic colloid layers constituting the photographic material according to the present invention may contain a dispersion of a synthetic polymer which is soluble or difficultly soluble in water, for the purpose of improving the dimensional stability and so on. Examples of the synthetic polymer include homopolymers of alkyl (meth)acrylate, alkoxyalkyl (meth)acrylate, (meth)acrylamide, vinyl ester, glycidyl (meth)acrylate, acrylonitrile, styrene and so on; copolymers comprising two or more of them; and copolymers comprising one or more of the above monomers and at least one member selected from acrylic acid, methacrylic acid, α,β-unsaturated carboxylic acids, styrenesulfonic acid and so on.

The above hydrophilic colloid layers of the photographic material other than the silver halide emulsion layer include a surface protecting layer, filter layer, antihalation layer, antistatic layer and so on. The hydrophilic colloid layers, such as a surface protecting layer, may contain a matting agent for the purpose of improving the anti-blacking properties and the surface state. Examples of the matting agent include particulate polymethyl methacrylate, methyl methacrylate-methacrylic acid copolymer, starch, silica and magnesium oxide as described in U.S. Pat. Nos. 2,701,245, 2,992,101, 4,142,894 and 4,396,706. Further, the surface protecting layer may contain a silicone compound as described in U.S. Pat. Nos. 3,489,576 or 4,047,958, a colloidal silica as described in JP-B-56- 23139, paraffin wax, a higher fatty acid ester or the like.

The hydrophilic colloid layer of the photographic material according to the present invention may contain an ultraviolet absorber. Examples of such an ultraviolet absorber include aryl-substituted benzotriazoles as described in U.S. Pat. Nos. 3,533,794 and 4,236,013, JP-B-51-6540 and EP-B-57,160; butadienes as described in U.S. Pat. No. 4,195,999; cinnamic acid esters as described in U.S. Pat. Nos. 3,705,805 and 3,707,375; benzophenones as described in U.S. Pat. No. 3,215,230 and GB 1,321,355; polymers having ultraviolet absorbing groups as described in U.S. Pat. Nos. 3,761,272 and 4,431,726. Alternatively, the hydrophilic colloid layer may contain an ultraviolet-absorbing brightening agent as described in U.S. Pat. Nos. 3,499,762 or 3,700,455.

The hydrophilic colloid layer of the photographic material according to the present invention may contain a water-soluble dye as a filter dye or for the prevention of irradiation or the like. Such a water-soluble dye includes oxonol dyes, hemioxonol dyes, styryl dyes, merocyanine dyes, cyanine dyes and azo dyes, among which oxonol dyes, hemioxonol dyes and merocyanine dyes are useful.

The emulsion layer and other hydrophilic colloid layers constituting the photographic material of the present invention may contain one or more anti-fading agents. Examples of the anti-fading agents include phenols and phenyl ethers as described in JP-A-59-125732; metal complexes as described in JP-A-60-97353, hindered amines and hindered phenols as described in JP-A-62-115157, metal complexes as described in JP-A-61-140941, and so on.

Further, the emulsion layer and other hydrophilic colloid layers of the photographic material according to the present invention may contain, as a plasticizer, a polyol such as trimethylolpropane, pentanediol, butanediol, ethylene glycol or glycerol. Furthermore, the emulsion layer and other hydrophilic colloid layers may contain one or more of brightening agents, development accelerators, pH regulators, thickening agents, antistatic agents and so on.

The substrate constituting the photographic material of the present invention includes films made of synthetic polymers such as cellulose triacetate, cellulose diacetate, nitrocellulose, polystyrene, polyethylene terephthalate, polycarbonate and so baryta paper, papers coated and laminated with α-olefin polymers (such as polyethylene and polypropylene); synthetic papers and so on. The substrate may be colored with a dye or a pigment. When the substrate is used as a reflector, it is preferable to add a white pigment to the base or the lamination layer. Examples of the white pigment include titanium dioxide, barium sulfate, zinc oxide, zinc sulfide, calcium carbonate, antimony trioxide, white silica pigment, white alumina pigment, titanium phosphate and so on. In particular, titanium dioxide, barium sulfate and zinc oxide are useful.

In general, a substratum is formed on the surface of the substrate to enhance the adhesion of the photographic emulsion thereto. Prior to the formation of the substratum, the surface of the substrate may be treated by corona discharge, irradiation with ultraviolet light or the like. When the substrate is used as a reflector, a hydrophilic colloid layer containing a white pigment at a high density may be formed between the substrate and the emulsion layer to thereby improve the whiteness and the sharpness of photographic images.

When a synthetic resin film integrally colored with a white pigment is used, the resulting photographic material can give a photographic image which is improved in smoothness, gloss and sharpness and is excellent in color saturation, chromaticness, images in the dark, delineation of shadow and so on. Polyethylene terephthalate and cellulose acetate are particularly useful as the material of the synthetic resin film, while barium sulfate and titanium oxide as the white pigment.

The silver halide photographic material of the present invention can form a black-and-white image through exposure from a black-and-white negative film or a Color negative film.

The color developer to be used in the present invention is preferably an aqueous alkaline solution containing an aromatic primary amine developing agent as the principal ingredient. Examples of the developing agent include 4-amino-N,N-diethylaniline, 3-methyl -4-amino-N,N-diethylaniline, 4-amino-N-ethyl-N-β-hydroxyethylaniline, 3-methyl-4-amino-N-ethyl-N-β-hydroxyethylaniline, 3-methyl -4-amino-N-ethyl-N-β-methanesulfonamidoethylaniline, 4-amino-3-methyl-N-ethyl-N-β-methoxyethylaniline and so on.

The color developer may contain a pH buffer selected from among carbonates, borates, phosphates and so on; an antifoggant selected from among bromides, iodides and organic antifoggants; or the like. If necessary, the color developer may contain one or more members selected from among water softeners; development accelerators such as alkali metal sulfites, diethylene glycol, polyethylene glycol, quaternary ammonium salts, amines and so on; competing couplers; fogging agents such as sodium borohydride; auxiliary developing agents such as 1-phenyl-3-pyrazolidone and so on; thickening agents; polycarboxylic acid type chelating agents described in U.S. Pat. No. 4,082,723; antioxidants described in DE 2,622,950 A1; and so on. The term "substantially free from benzyl alcohol" used with respect to the developer means that the benzyl alcohol content (of the developer) is 5 ml/liter or below. It is move preferable that the developer not contain benzyl alcohol at all.

In general, the silver halide photographic material of the present invention is subjected to bleaching after the completion of color development. The bleaching may be conducted simultaneously with fixing or separately therefrom. Examples of the bleaching agent usable in the present invention include compounds of polyvalent metals such as iron (III), cobalt (III), chromium (VI) and copper (II); peracids; quinones; and nitroso compounds. Specific examples thereof include ferricyanides; bichromates; organic acid salts of iron (III) and cobalt (III) such as complex salts thereof with aminopolycarboxylic acids (such as ethylenediamine-tetraacetic acid, nitrilotriacetic acid, 1,3-diamino-2-propanoltetraacetic acid and so on) and organic acids (such as citric acid, tartaric acid, malic acid and so on); persulfate salts; manganate salts; nitrosophenol and so on. Among these bleaching agents, iron (III) sodium ethylenediaminetetraacetate and iron (III) ammonium ethylenediaminetetraacetate are particularly useful. An iron (III) complex salt of ethylene-diaminetetraacetic acid is useful as both a bleaching bath and a bleach-fix bath. The photographic material may be washed with water after the color development or the bleach-fix. The color development may be conducted at an arbitrary temperature ranging from 18 to 55° C., preferably at 30° C. or above, particularly preferably at 35° C. or above. The development time ranges from about 1.5 minutes to about 20 seconds. A shorter development time is better. In continuous development, it is preferable to add a replenishing solution in an amount of 100 ml or above, still preferably 160 to 330 ml per square meter of the processed area. The bleach-fix is preferably conducted at 30° C. or above, though it may be conducted at an arbitrary temperature ranging from 18° to 50° C. When the bleach-fix is conducted at 35° C. or above, the processing time can be shortened to one minute or below and the amount of the replenishing solution to be added can be reduced. The time of washing conducted after color development or bleach-fix is generally at most one minute. Further, the washing may be completed within one minute with a stabilizing bath.

The formed dyes not only deteriorated by light, heat or humidity, but also deteriorate and fade by mildew during storage. It is preferable to add a mildewproofing agent to a cyan dye, because the dye significantly deteriorates by mildew. Specific examples of the mildewproofing agent include 2-thiazolylbenzimidazoles as described in JP-A-57-157244. The mildewproofing agent may be incorporated, in advance to use, into the silver halide photographic material or may be added in the development step. In other words, the mildewproofing agent may be added in an arbitrary step, as far as the agent can coexist with the processed photographic material.

The silver halide photographic material of the present invention exhibits nearly equal sensitivities and gamma values with respect to yellow, magenta and cyan to form a black-and-white image of neutral black or sepia tone, even when it is processed with a color developer substantially free from benzyl alcohol.

EXAMPLE

The present invention will now be described by referring to the following Examples.

Example 1

Silver halide emulsions were prepared according to the following formulae.

| | |
|---|---|
| Solution I | |
| deionized water | 1,000 ml |
| sodium chloride | 4.0 g |
| inert gelatin | 30 g |
| citric acid | 2.4 g |
| Solution II | |
| 1,3-dimethyl-2-imidazolidinethione (1% aqueous solution) | 2 ml |
| Solution III | |
| deionized water | 200 ml |
| sodium chloride | a g |
| potassium bromide | b g |
| Solution IV | |
| deionized water | 200 ml |
| silver nitrate | 40 g |
| Solution V | |
| deionized water | 400 ml |
| sodium chloride | c g |

-continued

| | |
|---|---|
| potassium bromide | d g |
| Solution VI | |
| deionized water | 400 ml |
| silver nitrate | 80 g |

The values of a to d are given in Table 1.

TABLE 1

| Emulsion No. | a (g) | b (g) | c (g) | d (g) | Silver bromide/silver chloride |
|---|---|---|---|---|---|
| Em-1 | 12.4 | 2.8 | 24.6 | 5.6 | 10/90 |
| Em-2 | 13.1 | 1.4 | 26.2 | 2.8 | 5/95 |
| Em-3 | 13.8 | 0 | 27.5 | 0 | 0/100 |

The solution I was dissolved at 55° C., followed by the addition of the solution II. After one minute, the solutions III and IV were simultaneously added over a period of 20 minutes. The obtained mixture was ripened for 10 minutes. The solutions V and VI were simultaneously added over a period of 30 minutes, followed by ripening for 10 minutes. After the completion of physical ripening, excess salts were eliminated from the emulsions thus prepared by the process described in Example 1 of U.S. Pat. No. 2,613,928. Water and gelatin were added to the resulting emulsion, followed by redissolution. The obtained emulsion was adjusted to pH6.0 and thereafter adjusted to 55° C. Sodium thiosulfate was added to the emulsion to conduct optimal chemical sensitization. The resulting emulsion was cooled to 40° C., followed by the addition of a sensitizing dye listed in Table 2 in an amount of $2.5\times10^{-4}$ mol per mol of silver. The emulsion thus obtained was allowed to stand for 20 minutes, followed by the addition of 4-hydroxy-6-methyl-1,3,3a,7-tetraazaindene in an amount of 50 mg per mol of silver.

Coupler dispersions were prepared as follows.

Couplers were dissolved in a mixture of dibutyl phthalate with ethyl acetate and the obtained solution was added to an aqueous solution of gelatin in the presence of a surfactant. The resulting mixture was finely dispersed by the use of an ultrasonic homogenizer.

A silver halide emulsion prepared above was mixed with the coupler dispersion prepared above. The resulting mixture was applied to a polyethylene-coated paper simulataneously with the formation of two other layers so as to give the following layer configuration.

| | |
|---|---|
| Top protective layer | |
| gelatin | 1.0 g/m² |
| Ultraviolet absorbing layer | |
| ultraviolet absorber A | 0.15 g/m² |
| ultraviolet absorber B | 0.20 g/m² |
| high-boiling solvent | 0.2 g/m² |
| gelatin | 0.6 g/m² |
| Silver halide emulsion layer | |
| silver halide emulsion | 0.7 g/m² |
| couplers | |
| high-boiling solvent | 1 g/m² |
| Tinuvin 144 | 0.1 g/m² |
| poly-t-butylacrylamide | 0.2 g/m² |
| gelatin | 1.5 g/m² |
| Irradiation-inhibiting dye A | 0.07 g/m² |

Substrate polyethylene-coated paper

The silver halide emulsions and couplers used in Example 1 and the amounts of the couplers are given in Table 2. The other additives are as follows:

High-boiling solvent n-dibutyl phthalate

Sensitizing dye A

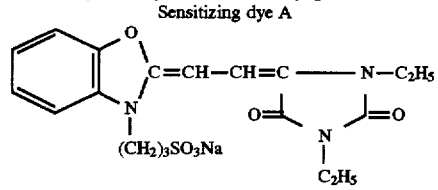

Irradiation inhibiting dye A

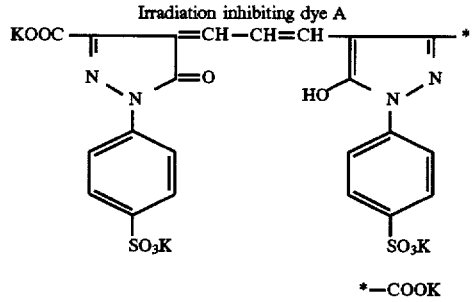

Ultraviolet absorber A

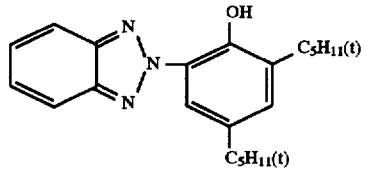

Ultraviolet absorber B

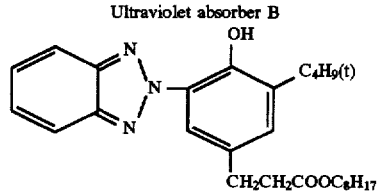

TABLE 2

| Sample No. | Emulsion | Sensitizing dye | Y-8 (mol/m²) | M-10 (mol/m²) | C-5 (mol/m²) |
|---|---|---|---|---|---|
| 1 (Comp.) | Em-1 | A | $5.5\times10^{-4}$ | $2.1\times10^{-4}$ | $4.2\times10^{-4}$ |
| 2 (Comp.) | " | I-3 | " | " | " |
| 3 (Comp.) | Em-2 | A | " | " | " |
| 4 (Comp.) | " | I-3 | " | " | 0 |
| 5 (Invention) | " | " | " | " | $4.2\times10^{-4}$ |
| 6 (Comp.) | Em-3 | " | 0 | " | " |
| 7 (Comp.) | " | " | $5.5\times10^{-4}$ | 0 | " |
| 8 (Invention) | " | " | " | $2.1\times10^{-4}$ | " |

The samples thus prepared were exposed by the use of a sensitometer (color temperature of light source: 3200 K) through an optical wedge, subjected to color development, bleach-fix and washing, which will be described below, and thereafter dried. The image densities obtained at the tenth stage (with the maximum density of the wedge being taken as the first stage) were determined through a blue, green or red filter by the use of a Macbeth densitometer, followed by the determination of the black-and-white density. The results are given in Table 3.

| Processing step | Temp. | Time |
|---|---|---|
| color development | 35° C. | 45 s |
| bleach-fix | 35° C. | 45 s |
| washing | 35° C. | 90 s |

| Color developing bath | |
|---|---|
| 4-amino-3-methyl-N-ethyl-N-(β-methylsulfonamido-ethyl)aniline sesquisulfate monohydrate | 6.1 g |
| triethanolamine | 8.2 g |
| nitrilotriacetic acid | 1.5 g |
| 1-hydroxyethylidene-1,1'-diphosphonic acid (60% aqueous solution) | 1.6 g |
| potassium hydroxide | 4.2 g |
| Cibanol SFP | 0.8 g |
| potassium carbonate | 0.9 g |
| N,N-diethylhydroxylamine | 4.0 g |

Water was added to make up to a total volume of 1 liter, and the pH of the resulting solution was adjusted to 10.10 with 10% sulfuric acid or a 20% aqueous solution of potassium hydroxide. Cibanol SFP is a brightening agent of Ciba Geigy A. G.

| | |
|---|---|
| iron (III) sodium ethylenediaminetetraacetate monohydrate | 48.0 g |
| disodium ethylenediaminetetraacetate dihydrate | 24.0 g |
| ammonium thiosulfate (70% aqueous solution) | 148 ml |
| sodium hydrogensulfite (anhydrous) | 15.0 g |

Water was added to make up to a total volume of 1 liter, and the resulting solution was adjusted to pH6.10 with 25% aqueous ammonia or 90% acetic acid.

Washing bath

| Washing bath | |
|---|---|
| methanol | 4.0 ml |
| p-hydroxybenzoic acid-n-butyl ester | 0.01 g |
| thiabendazole | 0.10 g |
| ethylene glycol | 6.0 ml |

Water was added to make up to a total volume of 1 liter. The pH of the resulting bath was 7.45.

TABLE 3

| Sample No. | D. of yellow | D. of magenta | D. of cyan | D. of black | Hue |
|---|---|---|---|---|---|
| 1 (Comp.) | 0.4 | 0.3 | 0.4 | 0.4 | black |
| 2 (Comp.) | 0.4 | 0.3 | 0.4 | 0.4 | black |
| 3 (Comp.) | 0.7 | 0.6 | 0.6 | 0.6 | black |
| 4 (Comp.) | 1.9 | 1.8 | 0.3 | 1.1 | red |
| 5 (Invention) | 1.9 | 1.9 | 1.8 | 1.9 | black |
| 6 (Comp.) | 0.4 | 1.8 | 1.7 | 1.1 | blue |
| 7 (Comp.) | 1.8 | 0.5 | 1.9 | 1.1 | green |
| 8 (Invention) | 2.0 | 2.1 | 2.1 | 2.1 | black |

It can be understood from the results given in Table 3 that the samples 5 and 8 according to the present invention can give dye images having high densities and a hue of black.

Further, the reciprocals of exposures giving a density (a) of fog plus 0.5, a density (b) of fog plus 1.0 and a density (c) of fog plus 1.50 were calculated and the relative sensitivities of each sample were determined by taking the yellow sensitivity of sample 5 at the density (a) as 100. The relative sensitivities of each sample at the densities (a), (b) and (c) are referred to as S5, S10 and S15 respectively. The results are given in Table 4, wherein the symbol "-" means "immeasurable".

TABLE 4

| | yellow | | | magenta | | | cyan | | |
|---|---|---|---|---|---|---|---|---|---|
| Sample No. | S5 | S10 | S15 | S5 | S10 | S15 | S5 | S10 | S15 |
| 1 (Comp.) | — | | — | — | — | — | — | — | — |
| 2 (Comp.) | — | — | — | — | — | — | — | — | — |
| 3 (Comp.) | 15 | — | — | — | — | — | — | — | — |
| 4 (Comp.) | 101 | 86 | 70 | 101 | 85 | 70 | — | — | — |
| 5 (Invention) | 100 | 85 | 71 | 101 | 86 | 71 | 100 | 86 | 70 |
| 6 (Comp.) | — | — | — | 92 | 77 | 62 | 96 | 80 | 66 |
| 7 (Comp.) | 103 | 88 | 73 | — | — | — | 99 | 85 | 69 |
| 8 (Invention) | 103 | 91 | 75 | 105 | 90 | 75 | 106 | 91 | 76 |

It can be understood from the results given in Table 4 that the samples 5 and 8 according to the present invention each exhibit yellow, magenta and cyan sensitivities (i.e., densities) which are nearly equal to each another over the whole density range including low, medium and high densities, and give a hue of black.

Example 2

Coupler dispersions were prepared as follows.

Couplers were dissolved in a mixture of dibutyl phthalate with ethyl acetate, and the obtained solution was added to an aqueous solution of gelatin in the presence of a surfactant. The obtained mixture was finely dispersed by the use of an ultrasonic homogenizer.

The dispersion thus prepared was mixed with a silver halide emulsion prepared in Example 1. The mixture thus obtained was applied to a polyethylene-coated paper simultaneously with the formation of two other layers so as to give the following layer configuration.

| | |
|---|---|
| Top protective layer | |
| gelatin | 1.0 g/m² |
| Ultraviolet absorbing layer | |
| ultraviolet absorber A | 0.15 g/m² |
| ultraviolet absorber B | 0.20 g/m² |
| high-boiling solvent | 0.2 g/m² |
| gelatin | 0.6 g/m² |
| Silver halide emulsion layer | |
| silver halide emulsion | 0.7 g/m² (in terms of silver) |
| couplers | |
| high-boiling solvent | 1 g/m² |
| gelatin | 1.5 g/m² |
| irradiation-inhibiting dye A | 0.07 g/m² |

Substrate polyethylene-coated paper

The silver halide emulsions and couplers used in Example 2 and the amounts of the couplers are given in Table 5. The other additives are as follows:

High-boiling solvent n-dibutyl phthalate

Sensitizing dye A

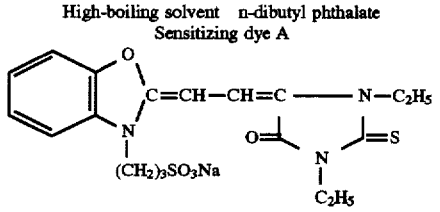

Irradiation inhibiting dye A

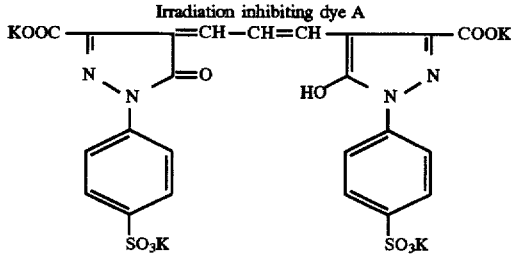

Ultraviolet absorber A

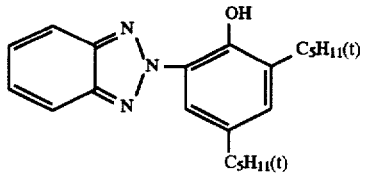

Ultraviolet absorber B

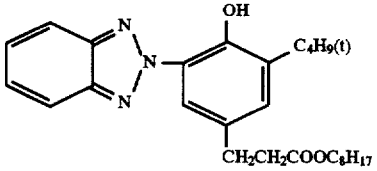

TABLE 5

| Sample No. | Emulsion | Sensitizing dye | Y-8 (mol/m²) | M-10 (mol/m²) | C-5 (mol/m²) |
|---|---|---|---|---|---|
| 9 (Comp.) | Em-1 | A | $5.5 \times 10^{-4}$ | $2.1 \times 10^{-4}$ | $4.2 \times 10^{-4}$ |
| 10 (Comp.) | " | II-20 | " | " | " |

TABLE 5-continued

| Sample No. | Emulsion | Sensitizing dye | Y-8 (mol/m²) | M-10 (mol/m²) | C-5 (mol/m²) |
|---|---|---|---|---|---|
| 11 (Comp.) | Em-2 | A | " | " | " |
| 12 (Comp.) | " | II-20 | " | " | 0 |
| 13 (Invention) | " | " | " | " | $4.2 \times 10^{-4}$ |
| 14 (Comp.) | Em-3 | " | 0 | " | " |
| 15 (Comp.) | " | " | $5.5 \times 10^{-4}$ | 0 | " |
| 16 (Invention) | " | " | " | $2.1 \times 10^{-4}$ | " |

In the same manner as that of Example 1, the samples thus prepared were subjected to exposure and development and the densities of the resulting images were determined. The results are given in Table 6.

TABLE 6

| Sample No. | D. of yellow | D. of magenta | D. of cyan | D. of black | Hue |
|---|---|---|---|---|---|
| 9 (Comp.) | 0.3 | 0.4 | 0.3 | 0.4 | black |
| 10 (Comp.) | 0.4 | 0.4 | 0.5 | 0.5 | black |
| 11 (Comp.) | 0.7 | 0.7 | 0.5 | 0.6 | black |
| 12 (Comp.) | 1.8 | 1.9 | 0.1 | 1.1 | red |
| 13 (Invention) | 1.8 | 1.9 | 1.8 | 1.9 | black |
| 14 (Comp.) | 0.1 | 1.7 | 1.8 | 1.1 | blue |
| 15 (Comp.) | 1.8 | 0.1 | 1.8 | 1.1 | green |
| 16 (Invention) | 1.9 | 2.1 | 2.0 | 2.0 | black |

It can be understood from the results given in Table 6 that the samples 13 and 16 according to the present invention give images having high densities and a hue of black.

Example 3

Coupler dispersions were prepared as follows.

Couplers were dissolved in a mixture of dibutyl phthalate with ethyl acetate, and the obtained solution was added to an aqueous solution of gelatin in the presence of a surfactant. The obtained mixture was finely dispersed by the use of an ultrasonic homogenizer.

The dispersion thus prepared was mixed with a silver halide emulsion prepared in Example 1. The mixture thus obtained was applied to a polyethylene-coated paper simultaneously with the formation of two other layers so as to give the following layer configuration.

| | |
|---|---|
| Top protective layer | |
| gelatin | 1.0 g/m² |
| Ultraviolet absorbing layer | |
| ultraviolet absorber A | 0.15 g/m² |
| ultraviolet absorber B | 0.20 g/m² |
| high-boiling solvent | 0.2 g/m² |
| gelatin | 0.6 g/m² |
| Silver halide emulsion layer | |
| silver halide emulsion | 0.7 g/m² (in terms of silver) |
| couplers | |
| high-boiling solvent | 1 g/m² |
| gelatin | 1.5 g/m² |
| irradiation-inhibiting dye A | 0.07 g/m² |

Substrate polyethylene-coated paper

The silver halide emulsions and couplers used in Example 3 and the amounts of the couplers are given in Table 7. The other additives are as follows:

High-boiling solvent n-dibutyl phthalate

Sensitizing dye B

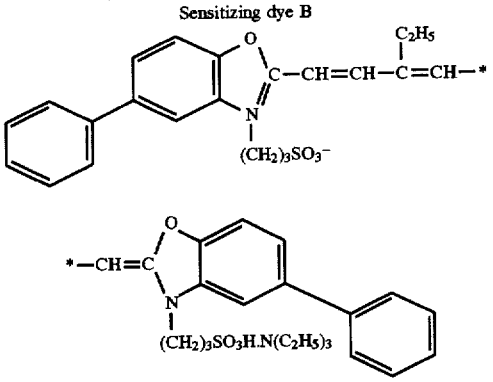

Irradiation inhibiting dye A

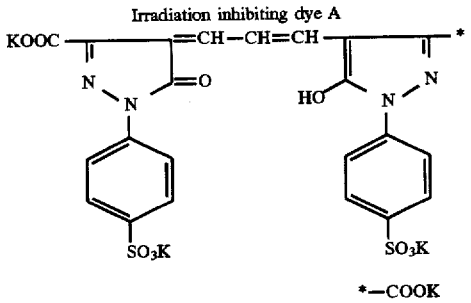

Ultraviolet absorber A

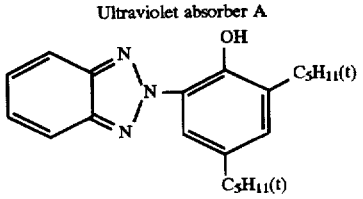

Ultraviolet absorber B

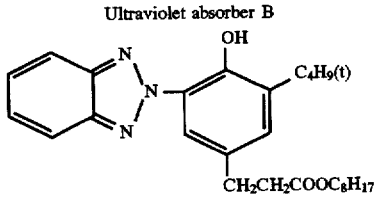

TABLE 7

| Sample No. | Emulsion | Sensitizing dye | Y-8 (mol/m²) | M-10 (mol/m²) | C-5 (mol/m²) |
|---|---|---|---|---|---|
| 17 (Comp.) | Em-1 | B | $5.5 \times 10^{-4}$ | $2.1 \times 10^{-4}$ | $4.2 \times 10^{-4}$ |
| 18 (Comp.) | " | IV-10 | " | " | " |
| 19 (Comp.) | Em-2 | B | " | " | " |
| 20 (Comp.) | " | IV-10 | " | " | 0 |
| 21 (Invention) | " | " | " | " | $4.2 \times 10^{-4}$ |
| 22 (Comp.) | Em-3 | " | 0 | " | " |
| 23 (Comp.) | " | " | $5.5 \times 10^{-4}$ | 0 | " |
| 24 (Invention) | " | " | " | $2.1 \times 10^{-4}$ | " |
| 25 (Invention) | " | III-3 | " | " | " |

In the same manners as that of Example 1, the samples thus prepared were subjected to exposure and development and the densities of the resulting images were determined. The results are given in Table 8.

TABLE 8

| Sample No. | D. of yellow | D. of magenta | D. of cyan | D. of black | Hue |
|---|---|---|---|---|---|
| 17 (Comp.) | 0.3 | 0.3 | 0.4 | 0.3 | black |
| 18 (Comp.) | 0.4 | 0.3 | 0.4 | 0.4 | black |
| 19 (Comp.) | 0.7 | 0.8 | 0.6 | 0.6 | black |
| 20 (Comp.) | 1.8 | 1.8 | 0.3 | 1.1 | red |
| 21 (Invention) | 1.8 | 1.8 | 1.9 | 1.8 | black |
| 22 (Comp.) | 0.4 | 1.8 | 1.8 | 1.0 | blue |
| 23 (Comp.) | 1.9 | 0.5 | 1.8 | 1.1 | green |
| 24 (Invention) | 1.8 | 2.0 | 1.9 | 1.9 | black |
| 25 (Invention) | 1.9 | 2.1 | 2.0 | 2.0 | black |

It can be understood from the results given in Table 8 that the samples 21, 24 and 25 according to the present invention give images having high densities and a hue of black.

Further, the reciprocals of exposures giving a density (a) of fog plus 0.5, a density (b) of fog plus 1.0 and a density (c) of fog plus 1.5 were calculated and the relative sensitivities of each sample were determined by taking the yellow sensitivity of sample 5 at the density (a) as 100. The relative sensitivities of each sample at the densities (a), (b) and (c) are referred to as S5, S10 and S15 respectively. The results are given in Table 9, wherein the symbol "-" means "immeasurable".

TABLE 9

| | yellow | | | magenta | | | cyan | | |
|---|---|---|---|---|---|---|---|---|---|
| Sample No. | S5 | S10 | S15 | S5 | S10 | S15 | S5 | S10 | S15 |
| 17 (Comp.) | — | | — | — | — | — | — | — | — |
| 18 (Comp.) | — | — | — | — | — | — | — | — | — |
| 19 (Comp.) | 13 | — | — | 14 | — | — | — | — | — |
| 20 (Comp.) | 101 | 87 | 71 | 101 | 85 | 69 | — | — | — |
| 21 (Invention) | 100 | 85 | 69 | 101 | 86 | 70 | 101 | 85 | 70 |
| 22 (Comp.) | — | — | — | 99 | 84 | 69 | 98 | 83 | 67 |
| 23 (Comp.) | 103 | 88 | 74 | — | — | — | 99 | 84 | 69 |
| 24 (Invention) | 103 | 89 | 73 | 105 | 90 | 74 | 104 | 89 | 74 |
| 25 (Invention) | 106 | 90 | 76 | 107 | 91 | 76 | 105 | 90 | 75 |

It can be understood from the results given in Table 9 that the samples 21, 24 and 25 according to the present invention each exhibit yellow and magenta and cyan sensitivities (i.e., densities) which are nearly equal to each other over the whole density range including low, medium and high densities, and give a hue of black.

Example 4

Coupler dispersions were prepared as follows.

Couplers were dissolved in a mixture of dibutyl phthalate with ethyl acetate, and the obtained solution was added to an aqueous solution of gelatin in the presence of a surfactant. The obtained mixture was finely dispersed by the use of an ultrasonic homogenizer.

The dispersion thus prepared was mixed with a silver halide emulsion prepared in Example 1. The mixture thus obtained was applied to a polyethylene-coated paper simultaneously with the formation of two other layers so as to give the following layer configuration.

| | |
|---|---|
| Top protective layer | |
| gelatin | 1.0 g/m$^2$ |
| Ultraviolet absorbing layer | |
| ultraviolet absorber A | 0.15 g/m$^2$ |
| ultraviolet absorber B | 0.20 g/m$^2$ |
| high-boiling solvent | 0.2 g/m$^2$ |
| gelatin | 0.6 g/m$^2$ |
| Silver halide emulsion layer | |
| silver halide emulsion | 0.7 g/m$^2$ (in terms of silver) |
| couplers | |
| high-boiling solvent | 1 g/m$^2$ |
| gelatin | 1.5 g/m$^2$ |
| irradiation-inhibiting dye A | 0.03 g/m$^2$ |
| irradiation-inhibiting dye B | 0.03 g/m$^2$ |
| Tinuvin 144 | 0.01 g/m$^2$ |

Substrate polyethylene-coated paper

The silver halide emulsions and couplers used in Example 4 and the amounts of the couplers are given in Table 10. The other additives are as follows:

High-boiling solvent n-dibutyl phthalate

Ultraviolet absorber A

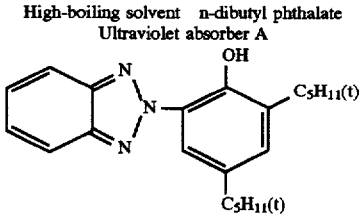

-continued

Ultraviolet absorber B

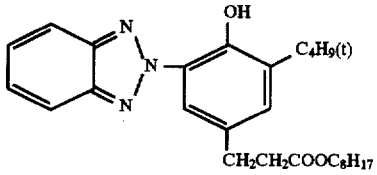

Irradiation-inhibiting dye B

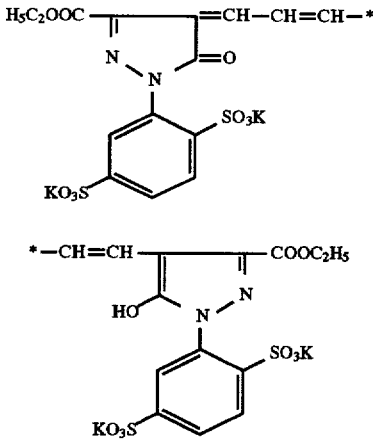

Irradiation inhibiting dye A

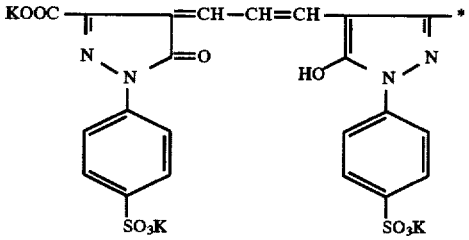

*—COOK

TABLE 10

| Sample No. | Emulsion | Sensitizing dye (mol/mol of Ag) | Yellow coupler (mol/m$^2$) | Magenta coupler (mol/m$^2$) | Cyan coupler (mol/m$^2$) |
|---|---|---|---|---|---|
| 26 (Comp.) | Em-1 | C $1 \times 10^{-4}$ | Y-8 | M-10 | C-7 |
| | | A $1.3 \times 10^{-4}$ | $5.5 \times 10^{-4}$ | $2.1 \times 10^{-4}$ | $4.2 \times 10^{-4}$ |
| | | B $4 \times 10^{-5}$ | | | |
| 27 (Comp.) | " | I-3 $1 \times 10^{-4}$ | Y-8 | M-10 | C-7 |
| | | II-20 $1.3 \times 10^{-4}$ | $5.5 \times 10^{-4}$ | $2.1 \times 10^{-4}$ | $4.2 \times 10^{-4}$ |
| | | IV-10 $4 \times 10^{-5}$ | | | |
| 28 (Comp.) | Em-2 | C $1 \times 10^{-4}$ | Y-8 | M-10 | C-7 |
| | | A $1.3 \times 10^{-4}$ | $5.5 \times 10^{-4}$ | $2.1 \times 10^{-4}$ | $4.2 \times 10^{-4}$ |
| | | B $4 \times 10^{-5}$ | | | |
| 29 (Comp.) | " | I-3 $1 \times 10^{-4}$ | Y-8 | M-10 | 0 |
| | | II-20 $1.3 \times 10^{-4}$ | $5.5 \times 10^{-4}$ | $2.1 \times 10^{-4}$ | |

TABLE 10-continued

| Sample No. | Emulsion | Sensitizing dye (mol/mol of Ag) | Yellow coupler (mol/m²) | Magenta coupler (mol/m²) | Cyan coupler (mol/m²) |
|---|---|---|---|---|---|
| 30 (Invention) | " | IV-10 $4 \times 10^{-5}$<br>I-3 $1 \times 10^{-4}$<br>II-20 $1.3 \times 10^{-4}$ | Y-8<br>$5.5 \times 10^{-4}$ | M-10<br>$2.1 \times 10^{-4}$ | C-7<br>$4.2 \times 10^{-4}$ |
| 31 (Invention) | " | IV-10 $4 \times 10^{-5}$<br>I-3 $1 \times 10^{-4}$<br>II-20 $1.3 \times 10^{-4}$ | Y-8<br>$5.8 \times 10^{-4}$ | M-10<br>$1.9 \times 10^{-4}$ | C-1<br>$4.6 \times 10^{-4}$ |
| 32 (Comp.) | Em-3 | IV-10 $4 \times 10^{-5}$<br>I-3 $1 \times 10^{-4}$<br>II-20 $1.3 \times 10^{-4}$ | 0 | M-10<br>$2.1 \times 10^{-4}$ | C-7<br>$4.2 \times 10^{-4}$ |
| 33 (Comp.) | " | IV-10 $4 \times 10^{-5}$<br>I-3 $1 \times 10^{-4}$<br>II-20 $1.3 \times 10^{-4}$ | Y-8<br>$5.5 \times 10^{-4}$ | 0 | C-7<br>$4.2 \times 10^{-4}$ |
| 34 (Invention) | " | IV-10 $4 \times 10^{-5}$<br>I-3 $1 \times 10^{-4}$<br>II-20 $1.3 \times 10^{-4}$ | Y-8<br>$5.5 \times 10^{-4}$ | M-10<br>$2.1 \times 10^{-4}$ | C-7<br>$4.2 \times 10^{-4}$ |
| 35 (Invention) | Em-3 | II-1 $4 \times 10^{-5}$<br>I-3 $1 \times 10^{-4}$<br>II-20 $1.3 \times 10^{-4}$ | Y-8<br>$5.5 \times 10^{-4}$ | M-10<br>$2.1 \times 10^{-4}$ | C-7<br>$4.2 \times 10^{-4}$ |
| 36 (Invention) | " | IV-10 $4 \times 10^{-5}$<br>I-3 $1 \times 10^{-4}$<br>II-20 $1.3 \times 10^{-4}$<br>IV-10 $4 \times 10^{-5}$ | Y-8<br>$5.8 \times 10^{-4}$ | M-10<br>$1.9 \times 10^{-4}$ | C-1<br>$4.6 \times 10^{-4}$ |

Sensitizing dye C

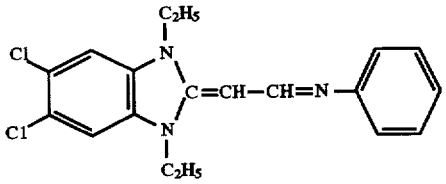

Sensitizing dye A

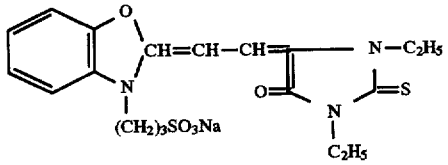

Sensitizing dye B

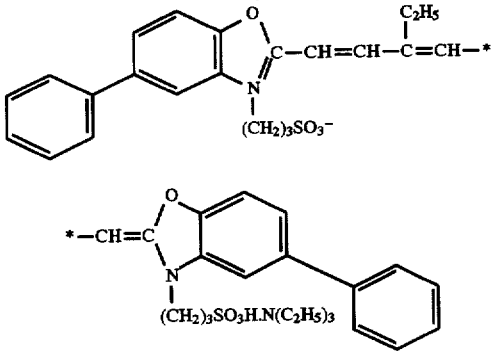

The samples thus prepared were exposed by the use of a sensitometer (color temperature of light source: 3200 K) fitted with Wratten No. 47B, No. 61 or No. 29 filter in front of the light source through an optical wedge, subjected to color development, bleach-fix and washing which will be described below, and thereafter dried.

| Processing step | Temp. | Time |
|---|---|---|
| color development | 35° C. | 45 s |
| bleach-fix | 35° C. | 45 s |
| washing | 35° C. | 90 s |

| Color developing bath | |
|---|---|
| 4-amino-3-methyl-N-ethyl-N-(β-methylsulfonamido-ethyl)aniline sesquisulfate monohydrate | 6.1 g |
| triethanolamine | 8.2 g |
| nitrilotriacetic acid | 1.5 g |
| 1-hydroxyethylidene-1,1'-diphosphonic acid (60% aqueous solution) | 1.6 g |
| potassium hydroxide | 4.2 g |
| Cibanol SFP | 0.8 g |
| potassium carbonate | 0.9 g |
| N,N-diethylhydroxylamine | 4.0 g |

Water was added to make up to a total volume of 1 liter, and the pH of the resulting solution was adjusted to 10.10 with 10% sulfuric acid or a 20% aqueous solution of potassium hydroxide. Cibanol SFP is a brightening agent of Ciba Geigy A. G. Bleach-fix bath

| | |
|---|---|
| iron (III) sodium ethylenediaminetetraacetate monohydrate | 48.0 g |
| disodium ethylenediaminetetraacetate dihydrate | 24.0 g |
| ammonium thiosulfate (70% aqueous solution) | 148 ml |
| sodium hydrogensulfite (anhydrous) | 15.0 g |

Water was added to make up to a total volume of 1 liter, and the resulting solution was adjusted to pH6.10 with 25% aqueous ammonia or 90% acetic acid.

| Washing bath | |
|---|---|
| methanol | 4.0 ml |
| n-butyl p-hydroxybenzoate | 0.01 g |
| thiabendazole | 0.10 g |
| ethylene glycol | 6.0 ml |

Water was added to make up to a total volume of 1 liter. The pH of the resulting bath was 7.45.

The images of optical wedge thus obtained were examined with a Machbeth densitometer through a blue, green or red filter. The reciprocals of exposures giving yellow, magenta and cyan densities of fog plus 1.0 were calculated and regarded as sensitivities. The relative sensitivities of each sample were determined by taking the yellow sensitivity of sample 30 as 100. Further, the gamma values (γ) of yellow, magenta and cyan of each sample were determined. The results are given in Tables 11 to 13. Table 11 shows the results obtained by exposure using Wratten No. 47B filter; Table 12 shows the results obtained by exposure using Wratten No. 61 filter; and Table 13 shows those obtained by exposure using Wratten No. 29 filter. The symbol "-" means "immeasurable".

TABLE 11

| | Yellow | | Magenta | | Cyan | | |
|---|---|---|---|---|---|---|---|
| Sample No. | sensitivity | γ | sensitivity | γ | sensitivity | γ | Hue |
| 26 (Comp.) | — | — | — | — | — | — | black |
| 27 (Comp.) | — | — | — | — | — | — | black |
| 28 (Comp.) | — | — | — | — | — | — | black |
| 29 (Comp.) | 101 | 2.63 | 101 | 2.67 | — | — | red |
| 30 (Invention) | 100 | 2.65 | 101 | 2.63 | 100 | 2.64 | black |
| 31 (Invention) | 102 | 2.70 | 100 | 2.67 | 98 | 2.57 | sepia |
| 32 (Comp.) | — | — | 99 | 2.58 | 98 | 2.56 | blue |
| 33 (Comp.) | 103 | 2.62 | — | — | 99 | 2.65 | green |
| 34 (Invention) | 103 | 2.70 | 104 | 2.73 | 103 | 2.71 | black |
| 35 (Invention) | 106 | 2.73 | 107 | 2.76 | 105 | 2.74 | black |
| 36 (Invention) | 105 | 2.69 | 106 | 2.70 | 102 | 2.64 | sepia |

TABLE 12

| | Yellow | | Magenta | | Cyan | | |
|---|---|---|---|---|---|---|---|
| Sample No. | sensitivity | γ | sensitivity | γ | sensitivity | γ | Hue |
| 26 (Comp.) | — | — | — | — | — | — | black |
| 27 (Comp.) | — | — | — | — | — | — | black |
| 28 (Comp.) | — | — | — | — | — | — | black |
| 29 (Comp.) | 102 | 2.45 | 102 | 2.67 | — | — | red |
| 30 (Invention) | 100 | 2.58 | 99 | 2.60 | 101 | 2.59 | black |
| 31 (Invention) | 101 | 2.60 | 99 | 2.58 | 98 | 2.50 | sepia |
| 32 (Comp.) | — | — | 100 | 2.58 | 99 | 2.61 | blue |
| 33 (Comp.) | 104 | 2.63 | — | — | 101 | 2.59 | green |
| 34 (Invention) | 102 | 2.60 | 103 | 2.62 | 101 | 2.58 | black |
| 35 (Invention) | 105 | 2.61 | 104 | 2.63 | 105 | 2.65 | black |
| 36 (Invention) | 103 | 2.58 | 100 | 2.60 | 97 | 2.55 | sepia |

TABLE 13

| | Yellow | | Magenta | | Cyan | | |
|---|---|---|---|---|---|---|---|
| Sample No. | sensitivity | γ | sensitivity | γ | sensitivity | γ | Hue |
| 26 (Comp.) | — | — | — | — | — | — | black |
| 27 (Comp.) | — | — | — | — | — | — | black |
| 28 (Comp.) | — | — | — | — | — | — | black |
| 29 (Comp.) | 101 | 2.55 | 102 | 2.60 | — | — | red |
| 30 (Invention) | 100 | 2.61 | 103 | 2.58 | 102 | 2.63 | black |
| 31 (Invention) | 102 | 2.59 | 101 | 2.58 | 99 | 2.55 | sepia |
| 32 (Comp.) | — | — | 100 | 2.55 | 101 | 2.60 | blue |
| 33 (Comp.) | 102 | 2.58 | — | — | 100 | 2.61 | green |
| 34 (Invention) | 101 | 2.65 | 103 | 2.60 | 101 | 2.70 | black |
| 35 (Invention) | 105 | 2.70 | 104 | 2.66 | 104 | 2.69 | black |
| 36 (Invention) | 106 | 2.70 | 104 | 2.69 | 102 | 2.63 | sepia |

It can be understood from the results given in Tables 11 to 13 that the samples 30, 34 and 35 according to the present invention each exhibit nearly equal sensitivities and gamma values with respect to yellow, magenta and cyan to give a hue of black, even when they are exposed to any of blue light, green light and red light and processed with a color developer substantially free from benzyl alcohol. Further, it can also be understood that the samples 31 and 36 give images having a sepia tone.

We claim:

1. A silver halide photographic material for producing a black and white image, said photographic material comprising a substrate and at least one silver halide emulsion layer formed on the substrate, said emulsion layer comprising silver halide grains containing 95 mole % or above of silver chloride, a yellow coupler, a magenta coupler and a cyan coupler and being spectrally sensitized by at least one sensitizing dye selected from the group consisting of sensitizing dyes having the formulae (I), (II), (III) and (IV):

Formula (I)

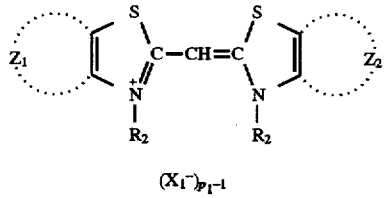

wherein $R_1$ and $R_2$ are each $C_1$–$C_6$ alkyl, $C_1$–$C_4$ substituted alkyl or aralkyl; $Z_1$ and $Z_2$ each form a benzene or naphthalene ring; $X_1$ is an anionic group; and $P_1$ is 1 or 2, with the proviso that when $p_1$ is 1, an inner salt is formed;

Formula (II)

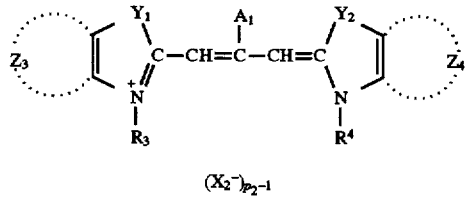

wherein $R_3$ and $R_4$ are each $C_1$–$C_6$ alkyl or sulfonated $C_1$–$C_6$alkyl; $A_1$ is hydrogen, $C_1$–$C_3$ alkyl, or aryl; $Y_1$ and $Y_2$ are each sulfur, oxygen, selenium or N—$R_5$ with $R_5$ being $C_1$–$C_3$ alkyl; $Z_3$ and $Z_4$ each form a benzene or naphthalene ring; $X_2$ is an anion; and $P_2$ is 1 or 2, with the proviso that when $P_2$ is 1, an inner salt is formed;

Formula (III)

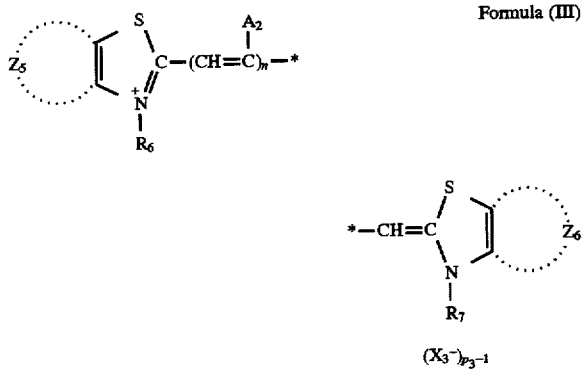

wherein $R_6$, $R_7$, $R_8$ and $R_9$ are each $C_1$–$C_6$ alkyl, $C_1$–$C_4$ substituted alkyl or aralkyl; $A_2$ is hydrogen, $C_1$–$C_3$ alkyl or aryl; $Z_5$, $Z_6$, $Z_7$ and $Z_8$ each form a benzene or naphthalene ring; $Z_9$ forms a six-membered ring; $X_3$ and $X_4$ are each an anionic group; n is 2; and $P_3$ and q are each 1 or 2, with the proviso that when P3 or q is 1, an inner salt is formed.

2. The silver halide photographic material as claimed in claim 1, in which said emulsion layer is spectrally sensitized by sensitizing dyes having the formulae (I), (II) and (III), respectively, in combination.

3. The silver halide photographic material as claimed in claim 1, in which said emulsion layer is spectrally sensitized by sensitizing dyes having the formulae (I), (II) and (IV), respectively, in combination.

4. The silver halide photographic material as claimed in claim 1, wherein the sensitizing dyes are used in a concentration of $10^{-6}$ to $10^{-3}$ mol per mol of silver halide contained in the emulsion layer.

5. The silver halide photographic material as claimed in claim 1, wherein the silver halide grains have a mean grain size no greater than 3 microns.

6. An image-forming process for forming a black and white image comprising the step of developing the silver halide photographic material as defined in claim 1 with a color developer containing no more than 5 ml/liter of benzyl alcohol.

7. The process as claimed in claim 6, in which said emulsion layer is spectrally sensitized by sensitizing dyes having the formulae (I), (II) and (III), respectively, in combination.

8. The process as claimed in claim 6, in which said emulsion layer is spectrally sensitized by sensitizing dyes having the formulae (I), (II) and (IV), respectively, in combination.

9. The silver halide photographic material as claimed in claim 4, wherein the color developer does not contain any benzyl alcohol.

* * * * *

UNITED STATES PATENT AND TRADEMARK OFFICE

CERTIFICATE OF CORRECTION

PATENT NO. : 5 728 511

DATED : March 17, 1998

INVENTOR(S) : Toshio HIROSAWA et al

It is certified that error appears in the above-indentified patent and that said Letters Patent is hereby corrected as shown below:

Column 44, lines 38-47; replace incorrect Formula (I) with the following Formula (I).

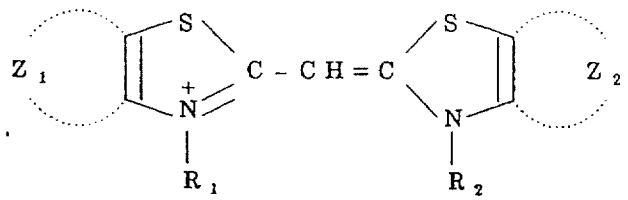

$(X_1^-)_{p_1-1}$

Column 44, line 50; change "$P_1$" to ---$p_1$---.

Column 44, line 66; change "$P_2$" to ---$p_2$---.

Column 44, line 67; change "$P_2$" to ---$p_2$---.

UNITED STATES PATENT AND TRADEMARK OFFICE

CERTIFICATE OF CORRECTION

PATENT NO. : 5 728 511

DATED : March 17, 1998

INVENTOR(S) : Toshio HIROSAWA et al

It is certified that error appears in the above-indentified patent and that said Letters Patent is hereby corrected as shown below:

Column 46, line 2; change "$P_3$" to ---$p_3$---.

Column 46, line 3; change "P3" to ---$p_3$---.

Column 46, line 33; change "claim 4" to ---claim 6---.

Signed and Sealed this

Twenty-first Day of July, 1998

Bruce Lehman

*Attest:*

BRUCE LEHMAN

*Attesting Officer*

*Commissioner of Patents and Trademarks*